US012607094B1

(12) United States Patent
Nelson et al.

(10) Patent No.: US 12,607,094 B1
(45) Date of Patent: Apr. 21, 2026

(54) SYSTEM AND METHOD FOR MANAGING TOOLS

(71) Applicant: Schlumberger Technology Corporation, Sugar Land, TX (US)

(72) Inventors: Keith Nelson, Sugar Land, TX (US); Nicholas Betancourt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/989,770

(22) Filed: Dec. 20, 2024

(51) Int. Cl.
*E21B 34/08* (2006.01)
*E21B 23/08* (2006.01)

(52) U.S. Cl.
CPC ..... *E21B 34/08* (2013.01); *E21B 23/08* (2013.01)

(58) Field of Classification Search
CPC ..... E21B 34/08; E21B 23/08
See application file for complete search history.

(56) References Cited

U.S. PATENT DOCUMENTS 3,163,224 A * 12/1964 Haeber et al. ..... E21B 33/064 166/345
4,386,422 A * 5/1983 Mumby ..... E21B 47/22 367/83
5,343,955 A * 9/1994 Williams ..... E21B 34/102 166/321
5,831,156 A * 11/1998 Mullins ..... E21B 34/16 166/250.17
7,347,270 B2 * 3/2008 McMillan ..... E21B 34/10 166/321
7,954,552 B2 * 6/2011 Mandrou ..... E21B 34/10 166/375
8,360,158 B2 * 1/2013 Mandrou ..... E21B 34/10 91/33
8,528,394 B2 * 9/2013 Eriksen ..... E21B 49/008 73/152.04
10,061,329 B1 * 8/2018 Coulston ..... E21B 34/08
2003/0051919 A1 * 3/2003 Moore ..... E21B 7/062 175/73
2004/0245018 A1 * 12/2004 Bloom ..... E21B 33/1208 175/51
2009/0014168 A1 * 1/2009 Tips ..... E21B 34/102 166/73

(Continued)

*Primary Examiner* — Steven A MacDonald
(74) *Attorney, Agent, or Firm* — Jeffrey D. Frantz

(57) ABSTRACT

Methods, systems, and computer readable storage mediums for managing testing of a well to facilitate completion of the well is disclosed. The system may include a tool usable to perform testing on the well. The tool may include a circulation assembly, a primary control assembly, and a secondary control assembly. The circulation assembly may be reconfigurable by selectively isolating an annulus of the well from a fluid chamber of the circulation assembly. The primary control assembly may facilitate reconfiguration of the circulation assembly to selectively isolate the annulus, and facilitate flowing of various fluids and gasses to perform the testing. The secondary control assembly may serve as a partial backup for the primary control assembly usable to address undesired conditions in the well when the primary control assembly is unable to reconfigure the circulation assembly independent to address the undesired conditions.

17 Claims, 16 Drawing Sheets

(56) References Cited

U.S. PATENT DOCUMENTS

| | | | | |
|---|---|---|---|---|
| 2009/0283276 | A1* | 11/2009 | Mandrou | E21B 34/10 166/375 |
| 2011/0284241 | A1* | 11/2011 | Mandrou | F15B 20/008 166/375 |
| 2015/0233207 | A1* | 8/2015 | Osborne | E21B 34/08 166/373 |
| 2018/0202261 | A1* | 7/2018 | Scott | E21B 34/16 |
| 2021/0396091 | A1* | 12/2021 | Cutler | F16K 31/0648 |
| 2022/0025722 | A1* | 1/2022 | Lymberopoulos | E21B 43/35 |
| 2025/0250896 | A1* | 8/2025 | Betancourt | E21B 49/081 |

* cited by examiner

SYSTEM AND METHOD FOR MANAGING TOOLS

BACKGROUND

Geological formations may host a range of resources. For example, geological formations may include trapped liquids and/or gasses that may include hydrocarbons of various types. These hydrocarbons may be used for a variety of purposes.

The geological formations may also be used for other purposes. For example, undesired materials may be sequestered in the geological formations. Greenhouse gases such as carbon dioxide may be sequestered in geological formations to limit impacts of the greenhouse gases on the environment.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an aspect, a tool for use with respect to a well is provided. The tool may include a circulation assembly adapted to reversibly place a fluid line to a surface facility in fluid communication with an annulus; a primary control assembly adapted to control the circulation assembly to reversibly place the fluid line to the surface in fluid communication with the annulus; and a secondary control assembly. The secondary control assembly may include an actuator adapted to override the control of the circulation assembly by the primary control assembly to control the circulation assembly while the primary control assembly is unable to control the circulation assembly. The secondary control assembly may also include an arming component adapted to actuate the actuator.

The actuator may include a valve assembly that is operably connected to flowlines between the circulation assembly and the primary control assembly. The flowlines may enable the primary assembly to control operation of the circulation assembly. The valve assembly, when actuated by the arming component, may isolate a first flowline of the flowlines from the fluid line; and place a second flowline of the flowlines in fluid communication with the annulus.

The second flowline may be adapted to be placed in fluid communication with a hydraulic chamber of the circulation assembly.

The hydraulic chamber may be isolated from the fluid line by a piston.

The piston is adapted to reversibly seal an opening in the circulation assembly. The fluid line may be isolated from the annulus when the opening is sealed. The fluid line may be in fluid communication with the annulus when the opening is unsealed.

The primary control assembly may include a pump that is adapted to pump a fluid via the second flow line with respect to the hydraulic chamber to actuate the piston to reversibly seal the opening.

The actuator may also include a reservoir adapted to receive pressurized fluid from isolation valves of the valve assembly when the valve assembly is actuated by the arming component.

The arming component may include a surface facility controlled valve adapted to reversibly place the pressurized fluid in fluid communication with the reservoir when the arming component actuates the valve assembly.

The pressurized fluid may be positioned with the isolation valves while the tool is not in the well.

The secondary control assembly may operate independently from the primary control assembly.

In an aspect, a method of testing a well that is positioned with a geological formation is provided. The method may include, while a tool is positioned in the well, making an identification that a primary control assembly adapted to control a circulation assembly to reversibly place a fluid line to the surface in fluid communication with an annulus has lost an ability to control the circulation assembly. The method may also include, based on the identification, activating an arming component of a secondary control assembly of the tool to override the control of the circulation assembly by the primary control assembly to control the circulation assembly while the primary control assembly is unable to control the circulation assembly. The method may further include, after activating the arming component, pumping from a surface facility to actuate the circulation assembly to place the fluid line to the surface in fluid communication with the annulus.

In an aspect, a non-transitory machine-readable medium having instructions stored therein, which when executed by a processor, cause a method for managing operation of a tool used in testing of a well is provided.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Embodiments disclosed herein are illustrated by way of example and not limitation in the figures of the accompanying drawings in which like references indicate similar elements.

DETAILED DESCRIPTION

Various embodiments will be described with reference to details discussed below, and the accompanying drawings will illustrate the various embodiments. The following description and drawings are illustrative and are not to be construed as limiting. Numerous specific details are described to provide a thorough understanding of various embodiments. However, in certain instances, well-known or conventional details are not described in order to provide a concise discussion of embodiments disclosed herein.

Reference in the specification to "one embodiment" or "an embodiment" means that a particular feature, structure, or characteristic described in conjunction with the embodiment can be included in at least one embodiment. The appearances of the phrases "in one embodiment" and "an embodiment" in various places in the specification do not necessarily all refer to the same embodiment.

Geological formations may be exploited to obtain various energy resources (e.g., hydrocarbons entrained in fluids/gases), to sequester undesired materials, and/or for other purposes. To exploit a geological formation, the properties (e.g., physical structure, thermal, etc.) of the geological formation may be characterized.

Figure 1:
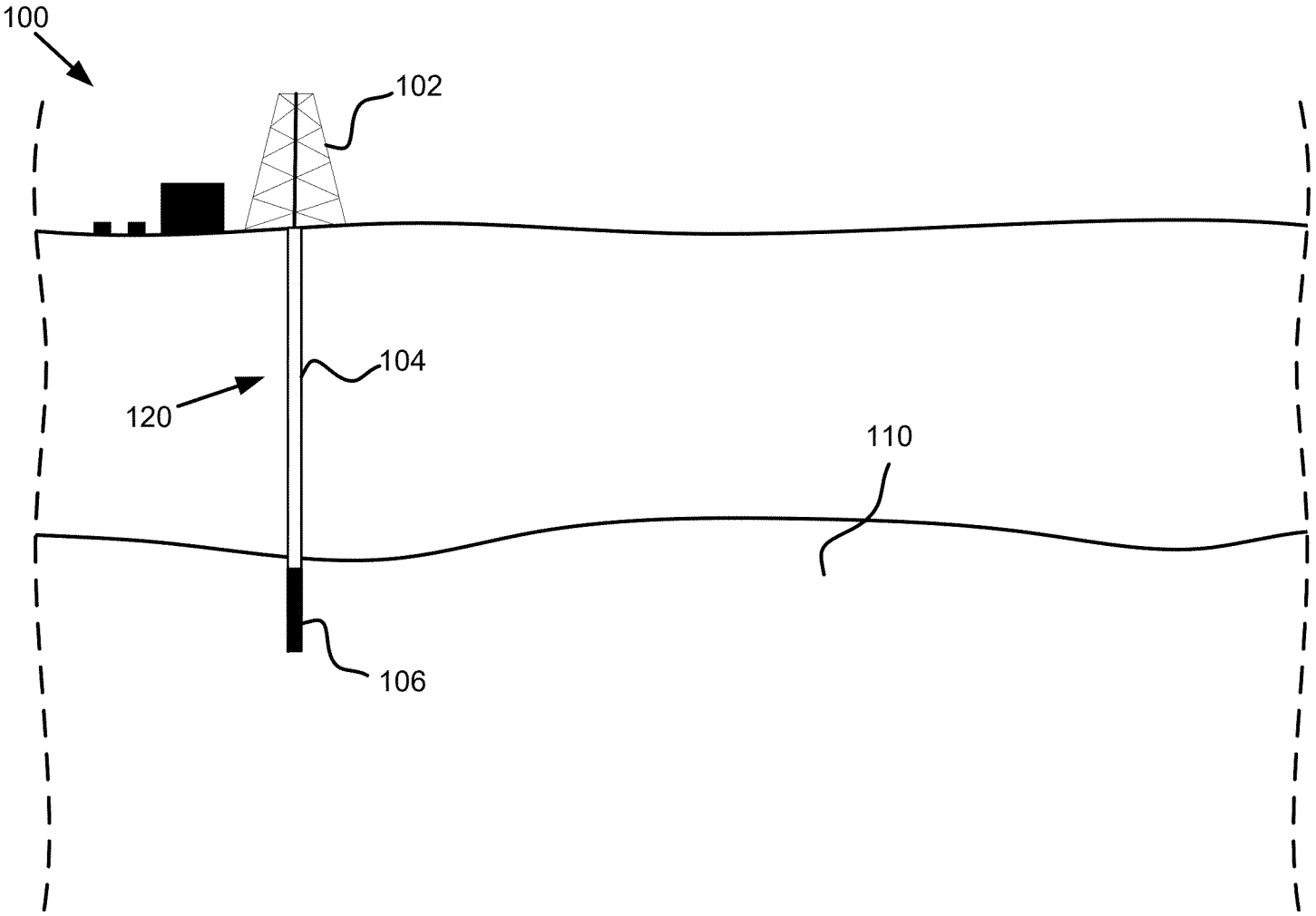
FIG. 1 shows a diagram illustrating a first system in accordance with an embodiment.

Turning to FIG. 1, a diagram of geological formation 110 in accordance with an embodiment is shown. Geological formation 110 may be a portion of the Earth's crust. In FIG. 1, geological formation 110 is illustrated as being positioned on land. However, it will be appreciated that embodiments disclosed herein may be used with respect to geological formation positioned below oceans or other bodies of water.

Geological formation 110 may be usable, for example, to sequester undesired materials (e.g., greenhouse gasses), produce energy resources (e.g., hydrocarbons), and/or for other purposes. To exploit geological formation 110, a well 120 may be drilled to provide for physical access to geological formation 110. In this manner, materials may be removed from and/or added to geological formation 110.

To decide how to exploit geological formation 110, information regarding the properties of geological formation 110 may be collected. To do so, a tool (e.g., 100) may be used. The tool may include any of surface facility 102, drill string 104, bottom hole assembly 106, and/or components not illustrated in FIG. 1.

Surface facility facility positioned above geological formation 110. While drawn in FIG. 1 as being positioned on land and including a derrick, the surface facility 102 may include a water born vessel such as a drill ship or other type of sea going vessel (e.g., a platform) without departing from embodiments disclosed herein.

Surface facility 102 may include, for example, (i) control systems for other components (e.g., bottom hole assembly 106), (ii) materials (e.g., drilling mud, water, gasses such as carbon dioxide) usable to form and characterize well 120 and/or geological formation 110, (iii) various assemblies and/or components usable with other assemblies, (iv) drill pipe and/or other components for well development, (v) completion components such as cement for completion of well 120, (vi) power systems, (vii) storage tanks for various materials used in well construction, (viii) pumps or other material movement components, and/or other materials, systems, etc. for well development.

Drill string 104 may include (i) any number of sections of drill pipe, (ii) wirelines usable to send control signals and/or power to downhole components, (iii) fluid lines and/or other lines for moving of fluids between bottom hole assembly 106 and/or surface facility 102, and/or other components usable as part of a drill string. Drill string 104 may connect bottom hole assembly 106 to surface facility 102, and may divide the wellbore into an annulus (e.g., area between outside of drill pipe/components and wellbore walls) and interior of tool 100.

Figure 2A:
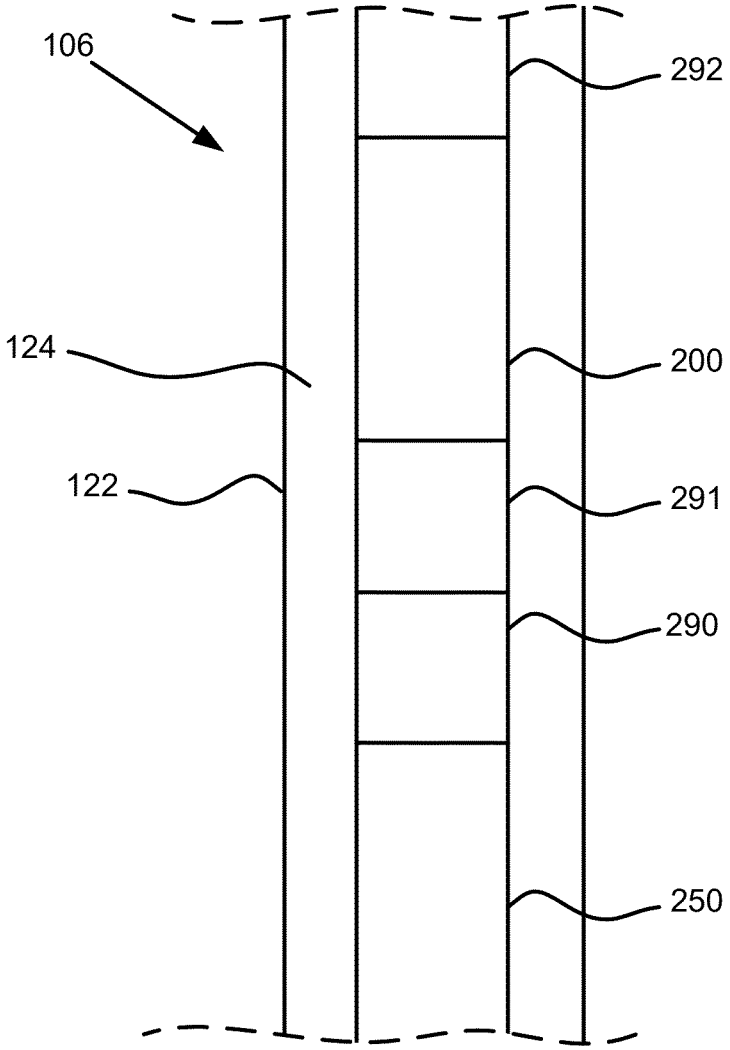
FIG. 2A shows a diagram illustrating a bottom hole assembly in accordance with an embodiment.

Bottom hole assembly 106 may provide for, in addition to other functions, performance of various tests on well 120 and/or portions of geological formation 110 proximate to well 120. Refer to FIG. 2A for additional details regarding bottom hole assembly 106.

In general, embodiments disclosed herein relate to methods and systems for completing wells, obtaining information to aid in the modeling of geological formations, and/or obtaining information usable to grade or characterize wells and/or geological formations for various uses. To obtain information regarding wells and geological formations, after wellbores are drilled, various intervals (e.g., portions of a well) along the wellbores and/or proximate portions of geological formation may be characterized using transient testing. An interval may be an isolated portion of the wellbore (e.g., isolated using packers or other space filling components). The transient testing may be performed by (i) isolating an interval, (ii) attempting to pump (and/or allow to flow due to existing pressure) fluids and/or gasses into and/or out of the intervals, (iii) measuring flow properties (e.g., fall off rates) during the pumping of the fluids and/or the gasses, (iv) using the measured flow properties to model and/or grade the interval with respect to one or more potential uses (e.g., such as material sequestration), and/or performing other actions usable to obtain information usable to guide well development.

While performing the testing, stability of the well may be impacted. To manage the stability of the well, bottom hole assemblies may include features to restabilize the well and to manage failures of components of the bottom hole assembly. For example, while performing testing pressure imbalances between interior of the bottom hole assembly and the annulus may develop. If left uncorrected, these pressure imbalances (and/or other stability issues) may impact operation of the well.

Once the model and/or grade are obtained, the model and/or grade (e.g., for any number of intervals) may be used to establish a completion plan (e.g., may define components for installation, location of the installations, etc.) for the well and/or exploitation plan (e.g., how to operate a completed well, and/or guide completion of the well to improve yield for various purposes) for the geological formation. The plans may be obtained in an automated (e.g., computer defined), semiautomated (e.g., computer guided with subject matter expert review/feedback), and/or manual (e.g., subject matter expert defined) manner using various test results.

Once obtained, the wells may then be completed and the geological formation may be exploited using the plans. Thus, the resulting wells and corresponding exploitation of the geological formation may be more likely to be desirable by virtue of the testing information used in the formulation of the plans.

For example, the testing may be used to identify portions of the geological formation that are better able to sequester various materials, better able to produce hydrocarbons, etc. Accordingly, a completion plan may, for example, be established with injection/extraction sites along the wellbore at these identified portions of the geological formation.

To perform the testing, various fluid connections between the surface facility and the geological formation may need to be selectively opened and closed over time during the testing and/or to stabilize the system. To do so, bottom hole assembly 106 may include various components that allow fluid connectivity between surface facility 102 and geological formation 110 to be established, as well as connections between the bottom hole assembly and wellbore to be established. FIGS. 2A-3H show diagrams based on portions of bottom hole assembly 106 in accordance with an embodiment.

Turning to FIG. 2A, a first diagram of bottom hole assembly 106 in accordance with an embodiment is shown. FIG. 2A and similar figures may show cross sections (e.g., down a center and/or along a length) of bottom hole assembly 106, and/or portions thereof. As noted above, bottom hole assembly 106 may allow various fluid connections of tool 100 to be dynamically established over time. For example, fluid connections between a top side facility and the geological formation may be dynamically changed by bottom hole assembly 106. The changes in fluid connectivity may allow testing of the geological formation to be performed, which may include pumping of various materials out of and into the geological formation over time and measuring characteristics (e.g., fall rate, pumping pressures, flow rates, etc.) of the pumping. These measured characteristics may facilitate modeling and exploitation of a geological formation.

During such pumping and measurement operations, portions of bottom hole assembly 106 may fail to operate. Consequently, some functions of bottom hole assembly 106 may become unavailable. To address such potential issues, bottom hole assembly 106 may include multiple control assemblies (e.g., 250, 291) that provide redundant (or supplementary) control over some functions of bottom hole assembly 106. Accordingly, loss of some functions of bottom hole assembly 106 may be recovered while down hole.

Bottom hole assembly 106 may include circulation assembly 200, control assembly 291, flow assembly 290, hydraulic assembly 250, and/or other assemblies (e.g., packers usable to isolate intervals of wells, production/sampling assemblies usable to extract/sample fluids produced from isolated intervals, downhole pump assemblies to pump various fluids, fluid analysis assemblies to analyze fluids as they are obtained, etc.). Each of these assemblies is discussed below.

Circulation assembly 200 may facilitate flowing of fluids into and/or out of a geological formation. To do so, circulation assembly 200 may be adapted to (i) connect to drill pipe 292 (e.g., part of a drill pipe string) which may be connected to a top side facility and through which fluids, power, information, and/or other things may be exchanged with the top side facility, and (ii) dynamically reconfigure fluid connections that it maintains. The fluid connections may be dynamically reconfigured to selectively isolate or connect flows of fluid within circulation assembly 200 to annulus 124 between bottom hole assembly 106 and wellbore wall 122. The fluid connections may be reconfigured as part of a testing process.

To reconfigure circulation assembly 200, other assemblies such as hydraulic assembly 250 (e.g., a primary control assembly) may provide services to circulation assembly 200. For example, hydraulic assembly 250 may provide fluid pumping services. The fluid pumping services may hydraulically actuate portions of circulation assembly 200.

Figure 2B:
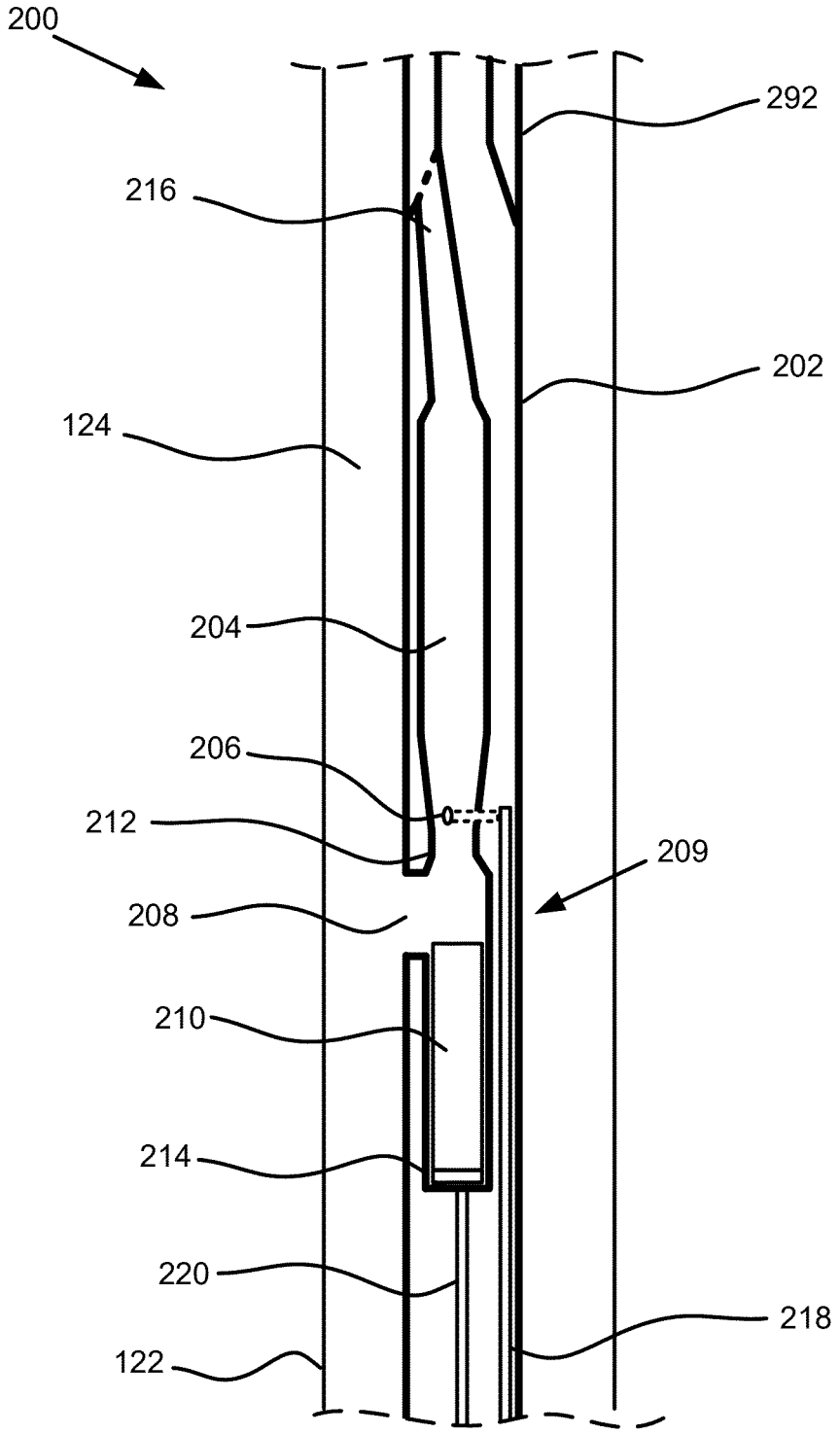
FIGS. 2B-2D show diagrams illustrating a circulation assembly in accordance with an embodiment.
Figure 2C:
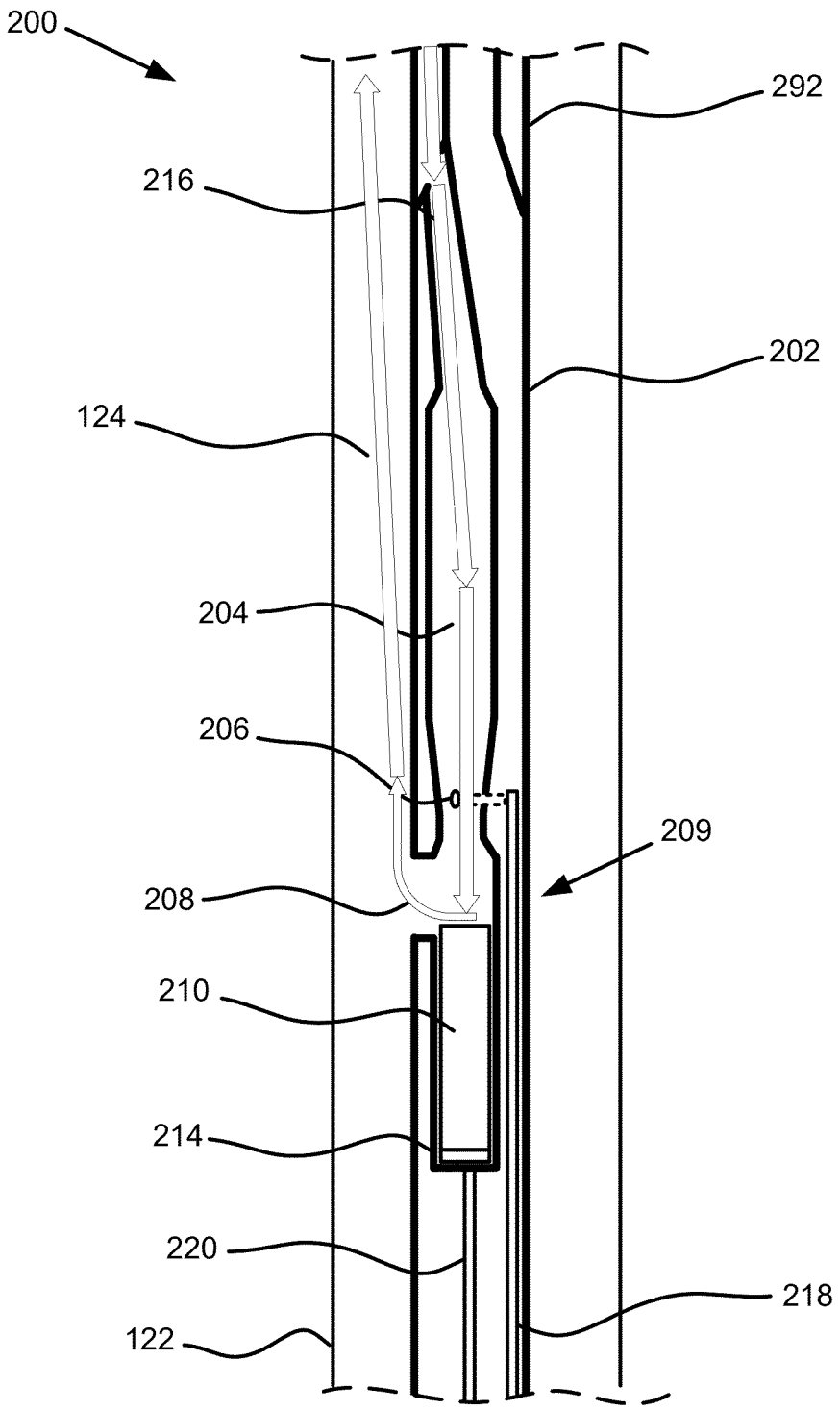
Figure 2D:
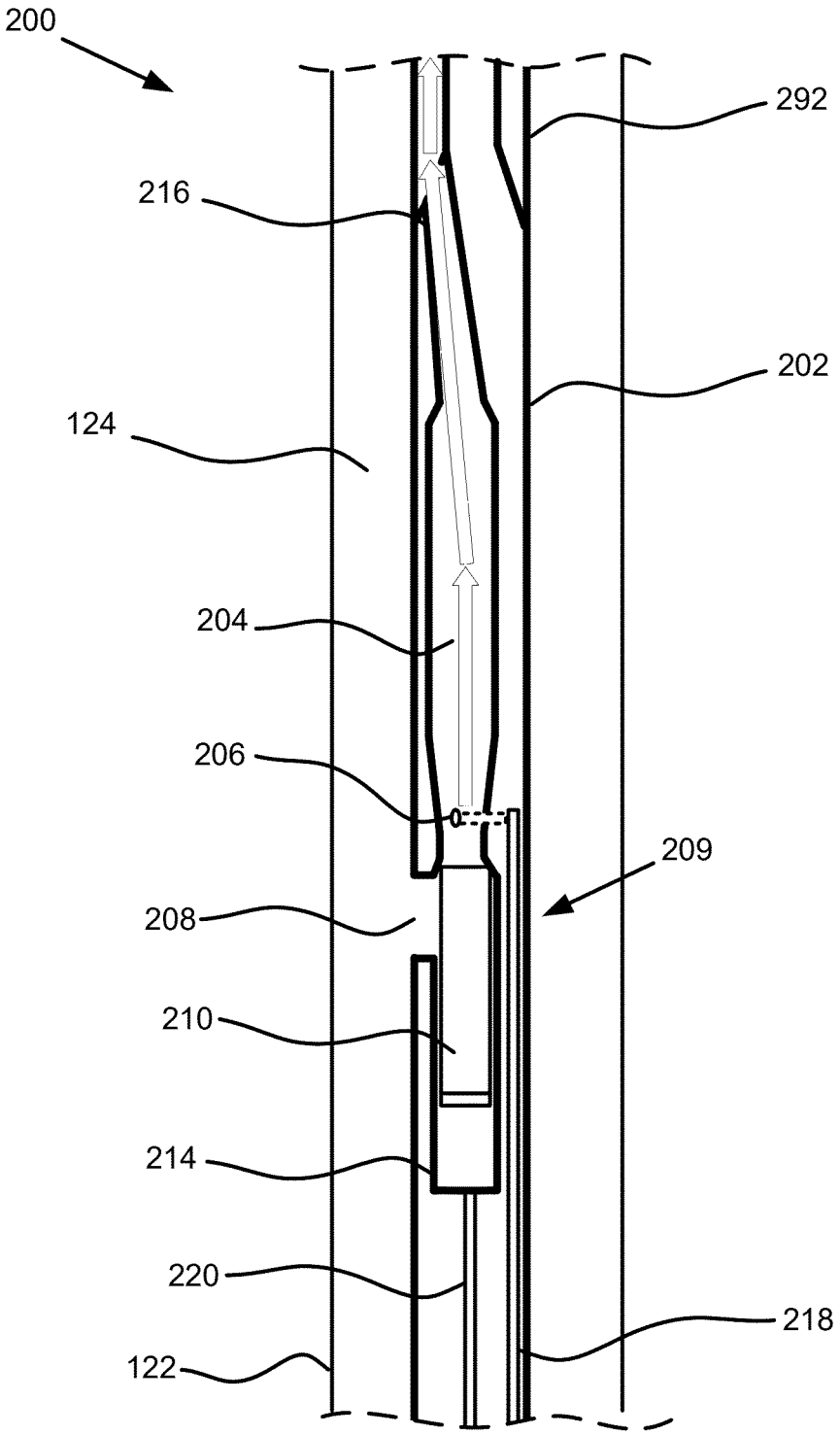

However, over time and for various reasons, the fluid pumping services may become unavailable. In such situations, secondary control assemblies such as control assembly 291 may supplement the now-lost service provided by hydraulic assembly 250. By doing so, failures of some services provided by and/or portions of bottom hole assembly 106 may be less likely to significantly impact the well. Refer to FIGS. 3A-3H for additional details regarding the supplemental services provided by control assembly 291 to circulation assembly 200. Refer to FIGS. 2B-2D for additional information regarding circulation assembly 200.

Flow assembly 290 may facilitate flows of fluids between hydraulic assembly 250 and circulation assembly 200. For example, flow assembly 290 may include various flowlines that form fluid connections between portions of circulation assembly 200 and hydraulic assembly 250.

Flow assembly 290 may also facilitate flows of power, data, and/or other things between circulation assembly 200, control assembly 291, and hydraulic assembly 250. For example, flow assembly 290 may include various wiring harnesses, cable bundles, etc. that facilitate such flows.

Hydraulic assembly 250 may facilitate flowing of fluids to (i) establish flows of formation fluids and/or other fluids (e.g., "test fluids") into and/or of a geological formation to circulation assembly 200, and (ii) establish flows usable to actuate circulation assembly 200 to modify its fluid connectivity. For example, a control system may utilize valves, pumps, and/or other components of hydraulic assembly 250 to flow fluids for sampling purposes, to drive hydraulic systems of circulation assembly 200, etc.

To do so, hydraulic assembly 250 may be in fluid communication with portions of circulation assembly 200 and sources of fluids via various flowlines. The sources of fluids may include pumps thereby providing access to pumped fluid sources. Hydraulic assembly 250 may also include valves, manifolds, and/or other structures usable to dynamically and/or statically modify the fluid connectivity provided by the flowlines. As part of various testing processes, and/or for other reasons, hydraulic assembly 250 may modify its fluid connectivity and/or the fluid connectivity of circulation assembly 200 to obtain measurements usable to derive properties of and/or uses for geological formations.

While not shown in FIG. 2A, hydraulic assembly 250 may be connected to other assemblies. For example, bottom hole assembly 106 may be connected to packer, sampling, drilling, and/or other types of assemblies as part of bottom hole assembly 106. Thus, these other assemblies may allow for isolating of intervals and flowing of materials to/from the isolated intervals.

Control assembly 291 may be positioned between flow assembly 290 and circulation assembly 200. When so positioned, control assembly 291 may be in fluid communication with flowlines between circulation assembly 200 and hydraulic assembly 250. The flowlines may support flows of fluids used in testing, actuation of circulation assembly 200, and/or for other purposes. Refer to FIGS. 3A-3H for additional details regarding control assembly 291 and circulation assembly 200.

Turning to FIG. 2B, a first diagram showing circulation assembly 200 in accordance with an embodiment is shown. As noted above, circulation assembly 200 may facilitate various flows usable for various purposes including, for example, reservoir testing. To facilitate the flows and corresponding purposes of the flows, circulation assembly 200 may be adapted to dynamically reconfigure its fluid connectivity. The configuration of the fluid connectivity may be used, for example, to prepare for and perform various tests.

To do so, circulation assembly may include tubular body 202, fluid chamber 204, any number of flow line ports (e.g., 206), one or more openings (e.g., 208), piston 210, one or more flow control components (e.g., not shown, but may be flapper valves or other one way valves positioned in fluid chamber 204), hydraulic chamber 214, fluid lines (e.g., 216), various flow lines (e.g., 218-220), and/or other components. Each of these components is discussed below.

Tubular body 202 may be a housing for other components of circulation assembly 200, and may facilitate attachment of and/or formation of operable connections to other assemblies/components to circulation assembly 200. For example, tubular body 202 may be a cylindrically shaped structure with various attachment points towards a top/bottom of circulation assembly 200. Additionally, tubular body 202 may include wire harnesses, flowlines, and/or other structures to establish operable connections (e.g., power, data, gas, fluid, and/or other types of connections) with to the other assemblies/components. In FIG. 2B (and FIGS. 2C-2D, a cross section through circulation assembly 200 is shown, which shows some internal structures that would otherwise not be visible from an exterior of circulation assembly 200).

The upper attachment points may allow for drill pipe 292 to be fixedly attached to tubular body. When so attached, various fluid lines, flow lines, data lines, power lines, flowlines, and/or other structures of drill pipe 292 may be operably connected to complementary structures of circulation assembly 200. For example, fluid line 216 may connect to a similar fluid line of drill pipe 292, which in turn may be connected to various top side components such as fluid/gas tanks, pumps, etc.

The lower attachment points may allow for tubular body 202 to be attached to other assemblies such as, for example, control assembly 291. When so attached, various fluid lines, flow lines, data lines, power lines, flowlines, and/or other structures of circulation assembly 200 may be operably connected to complementary structures of flow assembly 290 (which may in turn connect them to complementary structures of hydraulic assembly 250). For example, flowlines 218 and flowline 220 of circulation assembly 200 may be extended via complementary flowlines in flow assembly 290, control assembly 291, and/or hydraulic assembly 250 to place various portions of circulation assembly 200 in fluid communication with various portions of hydraulic assembly 250 and control assembly 291. These connections, as will be discussed in greater details with respect to FIGS. 3A-3H, may enable other assemblies to control flows of fluid into hydraulic chamber 214 and fluid chamber 204. Consequently, other assemblies may control the position of piston 210 and fluid flow through fluid chamber 204.

Fluid chamber 204 may be an interior region of circulation assembly 200 to which various fluids may be circulated. For example, fluid chamber 204 may be a hollow section of circulation assembly 200 inside of tubular body 202. Flowlines 218 may connect fluid chamber 204 to other assemblies.

Fluid chamber 204 may be in (i) fluid communication with various flow lines ports (e.g., 206) which may in turn place fluid chamber 204 in fluid communication with various portions of hydraulic assembly 250 and control assembly 291, and (ii) selective fluid communication with opening 208 which may in turn place fluid chamber 204 in fluid communication with annulus 124.

For example, any of the flowline ports may be in fluid communication via flowlines (e.g., 218) to portions of hydraulic assembly 250 and control assembly 291 thereby allowing fluids to flow between fluid chamber 204 and portions of hydraulic assembly 250/control assembly 291.

In another example, fluid chamber 204 may be in selective fluid communication with opening 208 that is controlled by fluid control system 209. Fluid control system 209 may selectively connect or isolate opening 208 and fluid chamber 204. To do so, fluid control system 209 may include piston 210, a retaining ring (e.g., 212), and hydraulic chamber 214.

Piston 210 may be implemented using a plug that is moveable between two positions. In a first position, piston 210 may seal the opening 208 from fluid chamber 204. In the second position, piston 210 may unseal the opening from fluid chamber 204. In FIG. 2B, piston 210 is illustrated in the second position thereby placing fluid chamber 204 in fluid communication with opening 208 (and in turn, annulus 124). Refer to FIG. 2D for an example of piston 210 being in the first position thereby sealing off fluid chamber 204 from opening 208. Piston 210 may be at least partially positioned in hydraulic chamber 214.

Hydraulic chamber 214 may be a chamber in which a portion of piston 210 is positioned. Piston 210 may seal the hydraulic chamber. Consequently, evacuating fluid from or pumping fluid into hydraulic chamber 214 may apply force to piston 210 to cause piston 210 to move between the two positions (and/or other positions). For example, flowline 220 may place hydraulic chamber 214 in fluid connection with a pump of hydraulic assembly 250. Operation of the pump may, therefore, fill or evacuate hydraulic chamber 214 thereby applying force to piston 210 to cause piston 210 to move between the two positions.

The retaining ring may be a portion of tubular body 202 that limits travel of piston 210. For example, the retaining ring may be an opening that is too small for piston 210 to traverse. The retaining ring may be positioned in line with a direction of travel of piston 210. Piston 210 may seal fluid chamber 204 from opening 208 when piston 210 is pressed against the retaining ring.

One or more flow control components may be positioned with fluid chamber 204. The flow control components may manage flows within fluid chamber 204. For example, the flow control components may operate as one way valves (or other type of flow control components), and may be implemented with flappers or other structures. When so positioned in fluid chamber 204, the flow control components may limit and/or prevent flows of material from fluid chamber 204, into the drill pipe string, and towards a surface facility.

The flow control components may be attached in a manner that allows for removal. The flow control components may be selectively added to and/or removed from fluid chamber 204. The flow control components may be added or removed depending, for example, on a workflow to be performed using circulation assembly 200. For example, to perform some types of formation testing, the flow control components may be positioned in fluid chamber 204 to cause fluids that flow into fluid chamber 204 to flow out of opening 208 and into annulus 124 rather than up the drill pipe string.

While not shown, various sensors (e.g., fluid pressure) may be positioned with the components of fluid control system 209 to allow for active feedback to be taken into account during actuation of fluid control system 209. For example, to move piston 210 to the first position, fluid may be pumped into hydraulic chamber 214 via flowline 220 which may initially cause piston 210 to move until its movement is limited by the retaining ring 212. After piston 210 has reached retaining ring 212, pressure may build. The pressure may be measured and used as a signal to indicate whether piston 210 has moved to the first position. Similar measurements may be used when fluid is evacuated from hydraulic chamber 214 to ascertain whether piston 210 has reached the second position. The sensors and/or other active components (e.g., microcontrollers, digital signal processors, etc.) of fluid control system 209 may be operably connected to other components via wire lines, harnesses, etc.

Any of the sensors may be positioned in other assemblies without departing from embodiments disclosed herein.

The information collected by these sensors and/or other types of sensors positioned with tool 100 may be used to provide information for real-time monitoring. For example, wirelines and/or other communication systems may transmit data based on the obtained information to surface facilities which may then use (e.g., at the surface facility) and/or distribute the data to data centers and/or other computer installations for real-time management, monitoring, etc.

Thus, circulation assembly 200 may be reconfigured to establish different fluid flow patterns by isolating opening 208 from fluid chamber 204, and pumping fluids into or out of fluid chamber 204. Refer to FIGS. 2C-2D for additional details regarding fluid flow patterns that may be established.

While fluid control system 209 is illustrated as being based on a hydraulic system to selectively isolate opening 208 from fluid chamber 204, fluid control system 209 may be based on other types of systems. For example, fluid control system 209 may be electromagnetic based (e.g., may include motors that modify the fluid connectivity between opening 208 and fluid chamber 204), may be mechanical (e.g., may include return springs and/or other mechanical elements that modify the fluid connectivity between opening 208 and fluid chamber 204), and/or may be based on other types of systems capable of selectively isolating opening 208 from fluid chamber 204.

Turning to FIG. 2C, a first diagram illustrating a first example fluid flow pattern in accordance with an embodiment is shown. In FIG. 2C, the fluid flow pattern is illustrated using oversized arrows. For example, in the configuration of circulation assembly 200 shown in FIG. 2C, piston 210 may be positioned to place opening 208 in fluid communication with fluid chamber 204. Consequently, when a material is pumped from the surface and down the drill pipe, the flow of material enters fluid chamber 204 and flows out of opening 208 into the annulus between the tool and wellbore wall 122. Accordingly, the flow of material from the surface circulates back to the surface via the annulus.

The aforementioned flow pattern may be established, for example, to fill the drill pipe with a particular material, to fill the annulus with the material, to purge existing material in the drill string and/or annulus from either area, to stabilize pressures in the well, and/or for other purposes.

In this first example fluid flow pattern, no materials may be pumped by the hydraulic assembly. Thus, material neither enters nor exits flowline port 206.

Turning to FIG. 2D, a second diagram illustrating a second example fluid flow pattern in accordance with an embodiment is shown. In FIG. 2D, the fluid flow pattern is illustrated using oversized arrows. For example, in the configuration of circulation assembly 200 shown in FIG. 2D, piston 210 may be positioned to place opening 208 in fluid communication with fluid chamber 204. Consequently, when a material is pumped by the hydraulic assembly into the fluid chamber (e.g., 204) via flowline 218 and flowline port 206, the flow of material enters fluid chamber 204 and flows along fluid line 216. Accordingly, the flow of material from the hydraulic assembly flows to the surface via the drill pipe.

The aforementioned flow pattern may be established, for example, to sample materials being produced by an isolated interval of a geological formation, or may occur when gasses are produced.

In this second example fluid flow pattern, no materials are pumped from the surface down through the drill pipe string. However, it will be appreciated that more generally the flow pattern shown in FIG. 2C may be used to facilitate pumping of material from the surface down drill pipe 292 and returned via annulus 124. In either pattern, gasses entrained in the material reaching the service may be degassed or otherwise separated from solid/liquids.

In addition to these patterns, various materials may also be pumped from isolated sections of a well using flowlines 218 and lower assemblies. Such materials may be pumped into fluid chamber 204 via flowline port 206 and in turn may flow up the drill string or out into the annulus.

To establish the aforementioned fluid flow patterns, various materials may be pumped by hydraulic assembly 250 via flow lines. For example, hydraulic assembly may include pumps that are in fluid communication with flowlines 218 and 220. Pumping material via flowline 220 may cause pressure in hydraulic chamber 214 to change. In turn, piston 210 may move between an open position (e.g., shown in FIG. 2C) and a closed position (e.g., shown in FIG. 2D). In contrast, pumps from hydraulic assembly 250 may be in fluid communication with flowlines 218. Consequently, material may be pumped into our out of fluid chamber 204. Thus, the different flowlines may be used for different purposes.

However, if hydraulic assembly 250 is unable to pump material, as discussed above, then piston 210 may be unable to be moved using hydraulic assembly 250. Accordingly, material may not be able to exit from fluid chamber 204 into annulus 124 via opening 208. If a sufficient pressure imbalance occurs (or other conditions impacting stability of the well occur), lack of access to annulus 124 may cause the well and/or bottom hole assembly to become damaged, inoperable, etc.

To reduce the likelihood of the annulus 124 being unable to be accessed, control assembly 291 may serve as a secondary control assembly for bottom hole assembly 106. Control assembly 291 may also be in fluid communication with flowlines 218 and flowline 220. In the event of hydraulic assembly 250 losing an ability to pump material via these flowlines, control assembly 291 may use its fluid connections to modify the pressures in the flowlines to reestablish fluid communication between the annulus and fluid chamber 204.

Figure 3A:
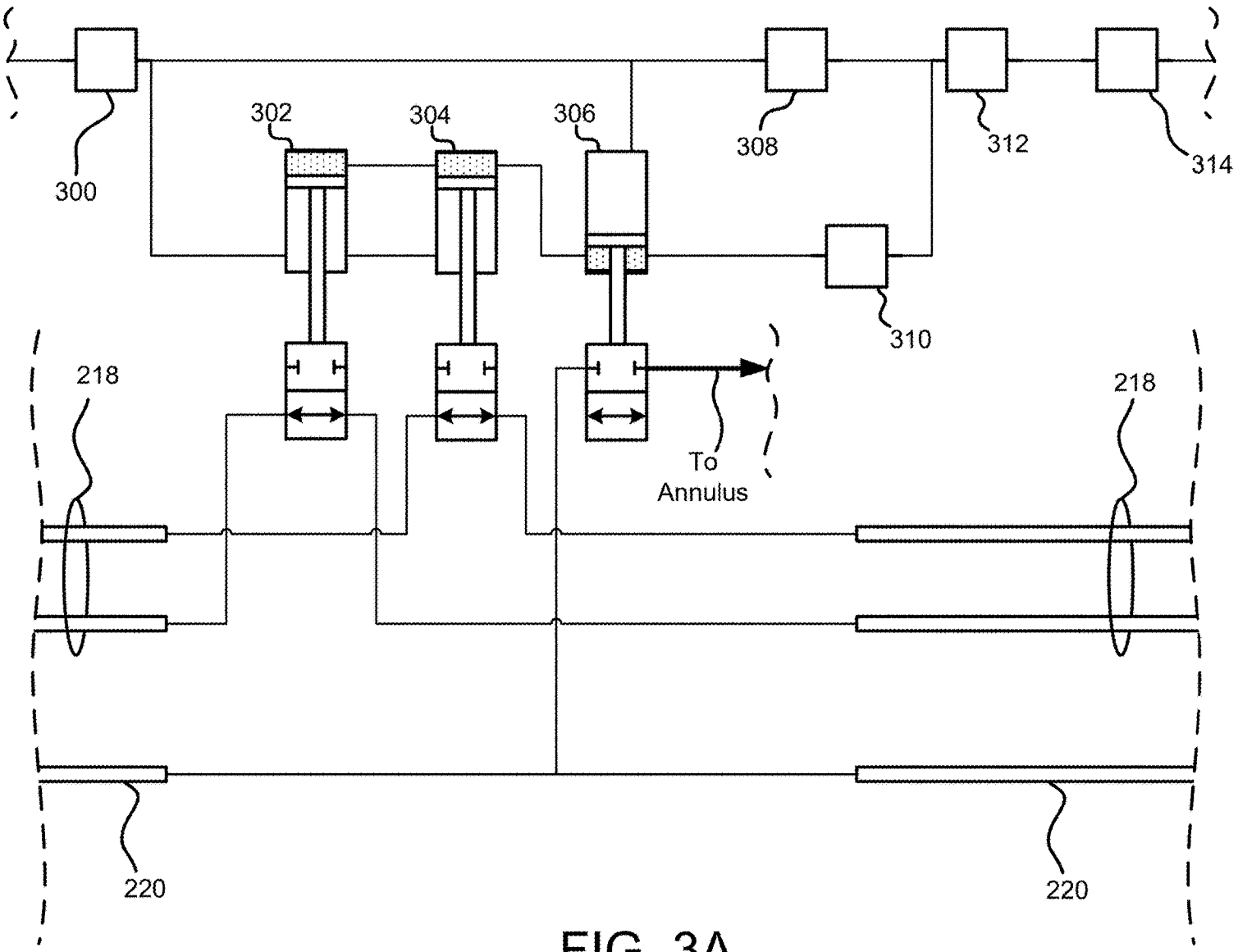
FIGS. 3A-3H show diagrams illustrating a control assembly and/or circulation assembly in accordance with an embodiment.

Turning to FIG. 3A, a first block diagram illustrating control functionality of control assembly 291 in accordance with an embodiment is shown. Flowlines 218 and flowline 220 may be in fluid communication with control assembly 291 (e.g., may be inline and/or in parallel with the flowlines, which in turn connect to hydraulic assembly 250 and/or other assemblies).

Control assembly 291 may include isolation valve 302 and isolation valve 304. Each isolation valve (e.g., 302, 304) may be in line with one of flowlines 218. Consequently, closing of isolation valve 302 and isolation valve 304, respectively, may isolate, respectively, the corresponding flowlines from pumps in hydraulic assembly 250 and/or other components of other assemblies (e.g., in FIG. 3A, circulation assembly may be to the left of the page and other assemblies including hydraulic assembly 250 may be to the right of the page, the dashed wavy lines on each side of the page indicate that the flow lines and/or other connections may continue beyond that illustrated in FIG. 3A, and other similar figures discussed below).

Control assembly 291 may also include isolation valve 306. In contrast to isolation valves 302-304, isolation valve 306 may selectively connect flowline 220 to the annulus of the well, as opposed to closing or opening flowlines 218. As will be discussed below, isolation valve 306 may be used to depressurize the hydraulic chamber of the circulation assembly while isolation valves 302-304 may be used to seal the fluid chamber of the circulation assembly to enable pumps positioned at a surface facility to actuate the piston while the hydraulic assembly or other assemblies of the bottom hole assembly are unable to do so.

The isolation valves (e.g., 302-306) may be part of a valve assembly. The valve assembly may selectively control pressures in circulation assembly 200 when hydraulic assembly 250 is unable to do so. To control the pressures, each of the isolation valves may include springs or other energy storage components. In FIG. 3A, the springs may be positioned in the area with dotted infill, and may tend to place the isolation valves in either open or closed positions (e.g., when force is not applied, the springs may return the valves to at rest positions). In FIG. 3A, the isolation valves are illustrated in a configuration after pressure has been applied to the isolation valves. For example, isolation valves 302-304 may be in open positions while isolation valve 306 is in a closed position, and all of the valves may be primed to move when the energy stored in the energy storage components is released. While in these positions, fluids may be pumped via flowlines 218 without impediment, and flowline 220 may be isolated from the annulus. Accordingly, pressure may be maintained in flowline 220 in this configuration thereby allowing hydraulic assembly 250 to move the piston in circulation assembly 200. This configuration may be referred to as an armed configuration.

To actuate the isolation valves (e.g., 302-306), control assembly 291 may also include an arming component. The arming component may enable pressure to be applied to the isolation valves, and the pressure to be selectively relieved thereby allowing the isolation valves to actuate (e.g., closing isolation valves 302-304 and opening isolation valve 306). To provide its functionality, the arming component may include fill valve 300, valve 308, compensation circuit 310, compensation reservoir 312, and relief valve 314.

Fill valve 300 may selectively connect external lines (e.g., shown as continuing to the left of the page in FIG. 3A using dashed lines) to pressure receiving portions of the isolation valves (e.g., fluids may be pumped into the valve bodies). When so connected, fluids may be pumped via the external lines thereby applying pressure to the springs or other energy storage mechanisms of the isolation valves (e.g., placing them in the armed configuration when sufficient pressure is applied). The pumping may move a piston inside the respective pump body that compresses the spring (e.g., on the other side of the piston in the valve body).

Valve 308 may be a remotely controllable valve (e.g., from a surface facility or other control system) for relieving the pressure applied to the isolation valves. Valve 308 may be a computer control or other type of remotely controllable valve. For example, valve 308 may enable the pressure to be relieved through fluid flow out of the isolation valves (e.g., out of the valve bodies due to force applied by the spring in the valve body) and/or relief valve 314 (and/or out into an annulus as indicated by the dashed wavy line on the right hand side of the page). Compensation reservoir 312 may be a reservoir held above (e.g., slightly above) hydrostatic pressure in the borehole.

Compensation circuit 310 may compensate for pressures in the valve assembly, thereby reducing the likelihood of undesired operation of the valve assembly (e.g., during release of the pressure applied to the isolation valves).

When valve 308 actuates, the energy stored in the isolation valves may be released thereby causing the positions (e.g., open/closed) to change.

Figure 3B:
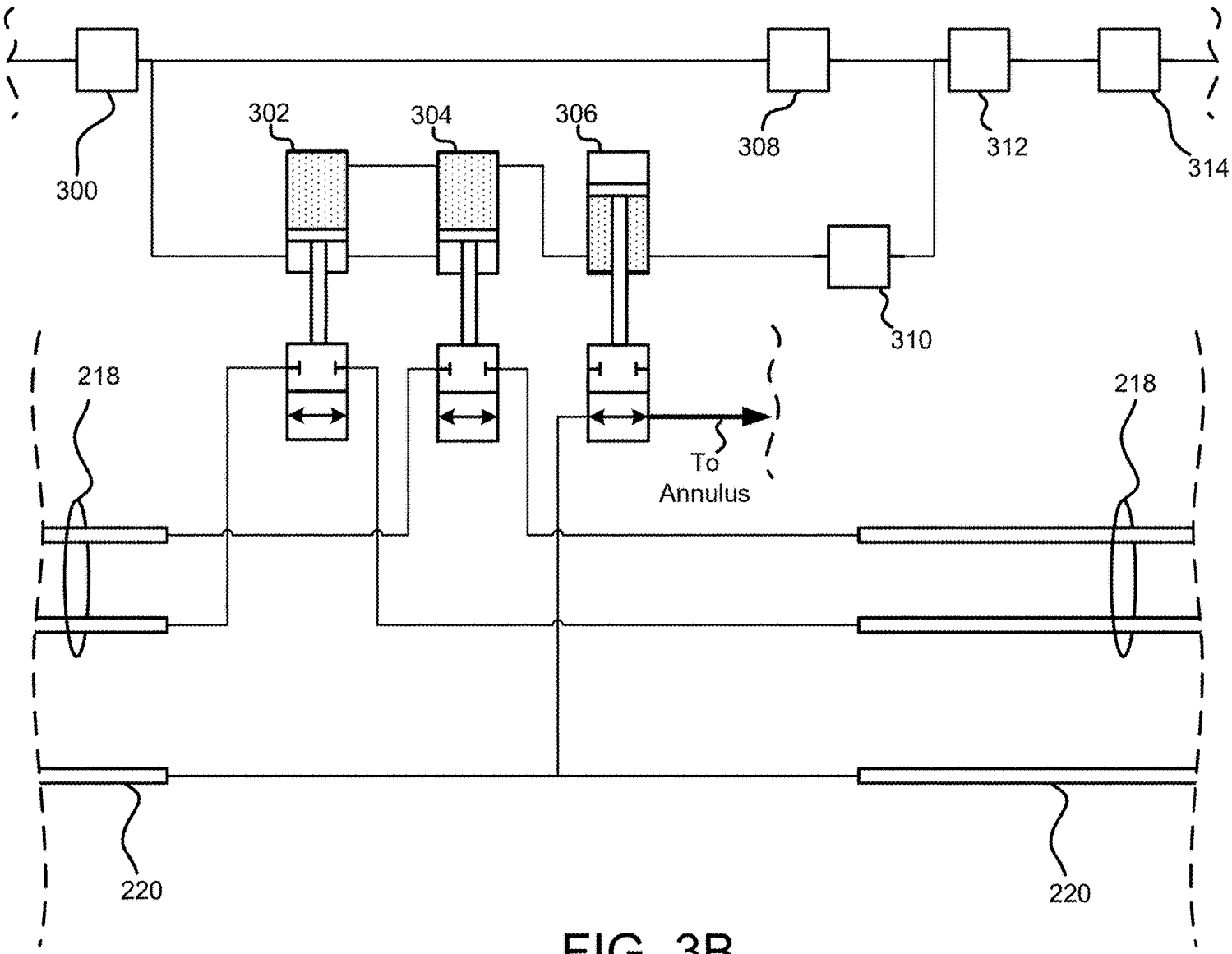

Turning to FIG. 3B, a second block diagram illustrating control functionality of control assembly 291 in accordance with an embodiment is shown. FIG. 3B illustrates the states of the isolation valves after valve 308 has been actuated. For example, in contrast to the illustrated state of the isolation valves in FIG. 3A, in FIG. 3B, isolation valves 302-304 are now in closed states while isolation valve 306 is in an open state.

In this state, flowline 220 may be depressurized by venting fluid into the annulus via isolation valve 306. Corresponding pressure in the hydraulic chamber of circulation assembly 200 may also be relieved. Accordingly, the piston may move when pressure is increased in fluid chamber 204 via pumping of material from surface facilities.

Additionally, by closing isolation valves 302-304, flowlines 218 may be sealed thereby preventing fluid flow out of flowline port 206 from fluid chamber 204. Accordingly, high pressures in fluid chamber 204 may be established to facilitate movement of piston 210 to an open position (e.g., as shown in FIG. 2B).

Figure 3C:
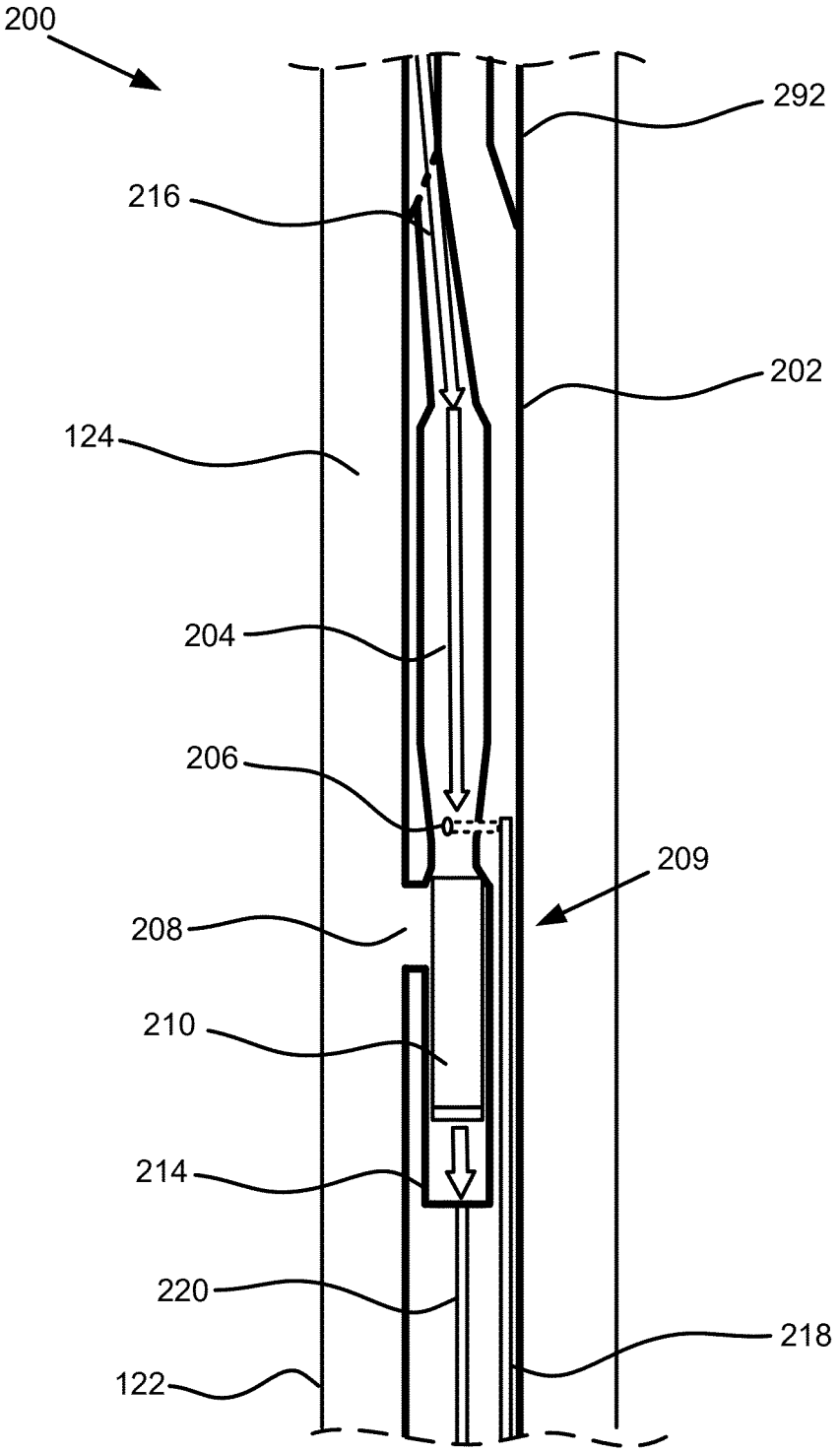

For example, turning to FIG. 3C, a side view diagram similar to that shown in FIG. 2A in accordance with an embodiment is shown. In FIG. 3C, a flow of material pumped from a surface facility is illustrated using oversized arrows.

Figure 3D:
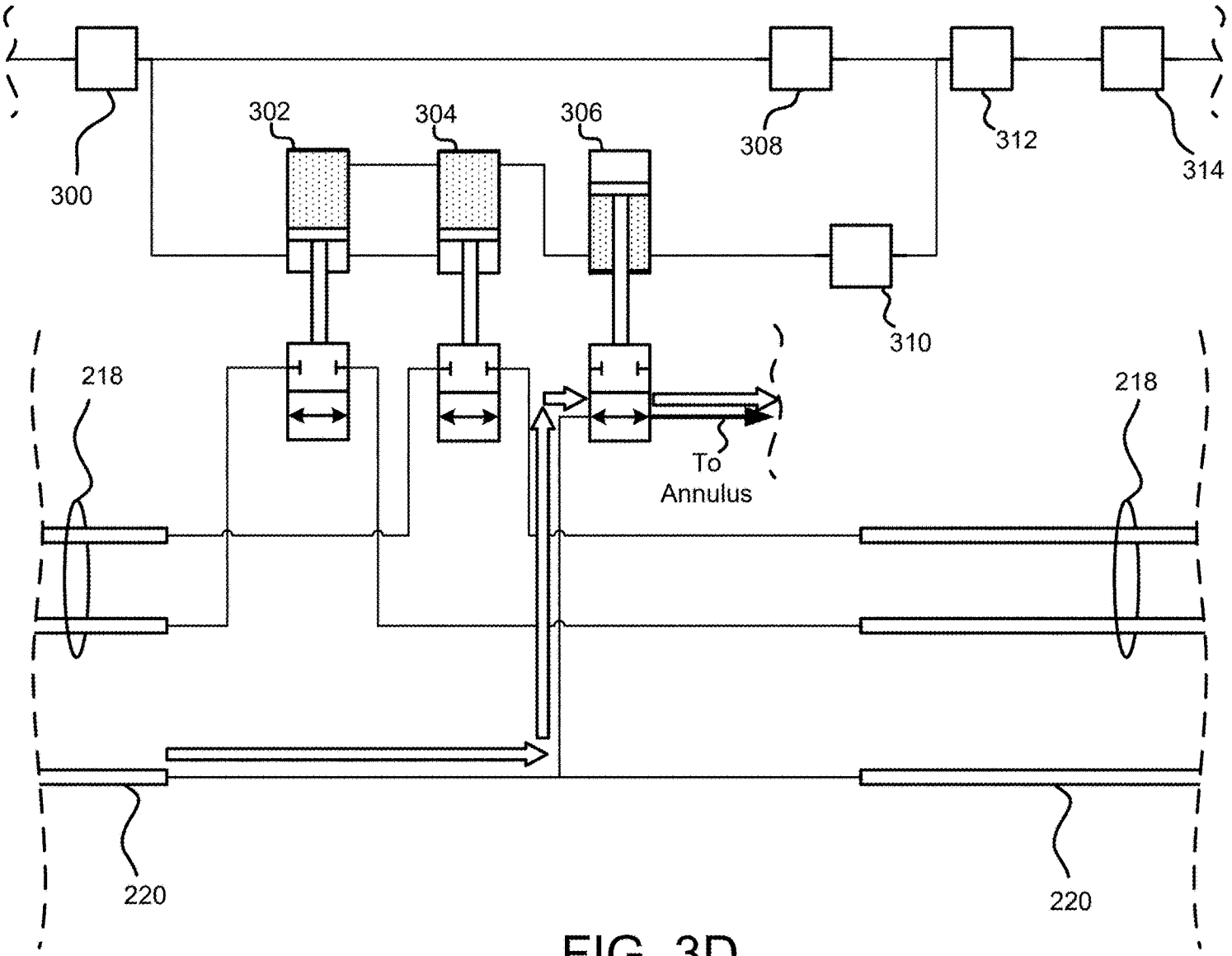

To move piston 210 while the hydraulic assembly is unable to pump fluid into and/or out of hydraulic chamber, the control assembly may be activated leading to the valve configuration as shown in FIG. 3B. Based on that valve configuration, the flow from the surface facility may be trapped in fluid chamber 204 thereby increasing the pressure applied to piston 210. The applied pressure may cause fluid in hydraulic chamber 214 to flow through flowline 220, through isolation valve 306, and out into the annulus of the well. Refer to FIG. 3D for additional details regarding the flow through the control assembly.

The relieved pressure hydraulic chamber 214 may enable piston 210 to move from the closed position to the open position. For example, turning to FIG. 3E, a second side view diagram similar to that shown in FIG. 2B in accordance with an embodiment is shown. The view shown in FIG. 3E may reflect the state of circulation assembly 200 after piston 210 has moved due to (i) pumping from the surface, and (ii) evacuation of fluid from hydraulic chamber 214 via the control module.

Figure 3E:
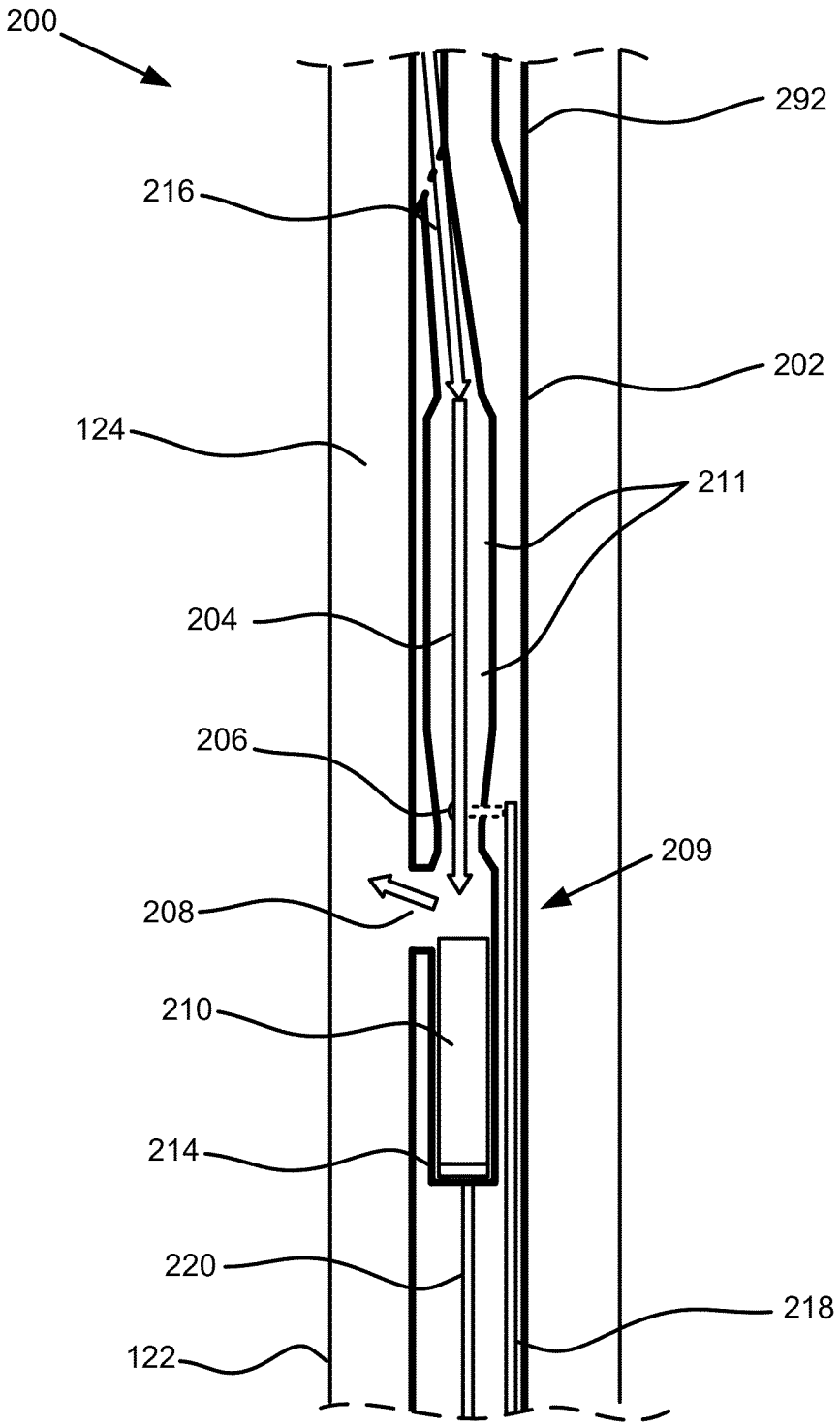

Turning to FIG. 3D, a second block diagram illustrating control functionality of control assembly 291 in accordance with an embodiment is shown. In the diagram, a flow of fluid is shown using oversized arrows. As discussed with respect to FIG. 3B, while surface facilities pump material down to the bottom hole assembly, fluid from the hydraulic chamber of the circulation assembly may flow through flowline 220, through isolation valve 306, and out into the annulus. Accordingly, the piston in the circulation assembly may move to the open position, as illustrated in FIG. 3E.

Thus, the piston may be moved using the secondary control assembly (e.g., 291) while a primary control assembly (e.g., 250) is unable to move the piston. Consequently, various stabilization operations and/or other types of operations may continue to be performed.

While the control assembly has been illustrated in FIGS. 3A, 3B, and 3D with specific example components, it will be appreciated that a control assembly may include different components without departing from embodiments disclosed herein.

Figure 3F:
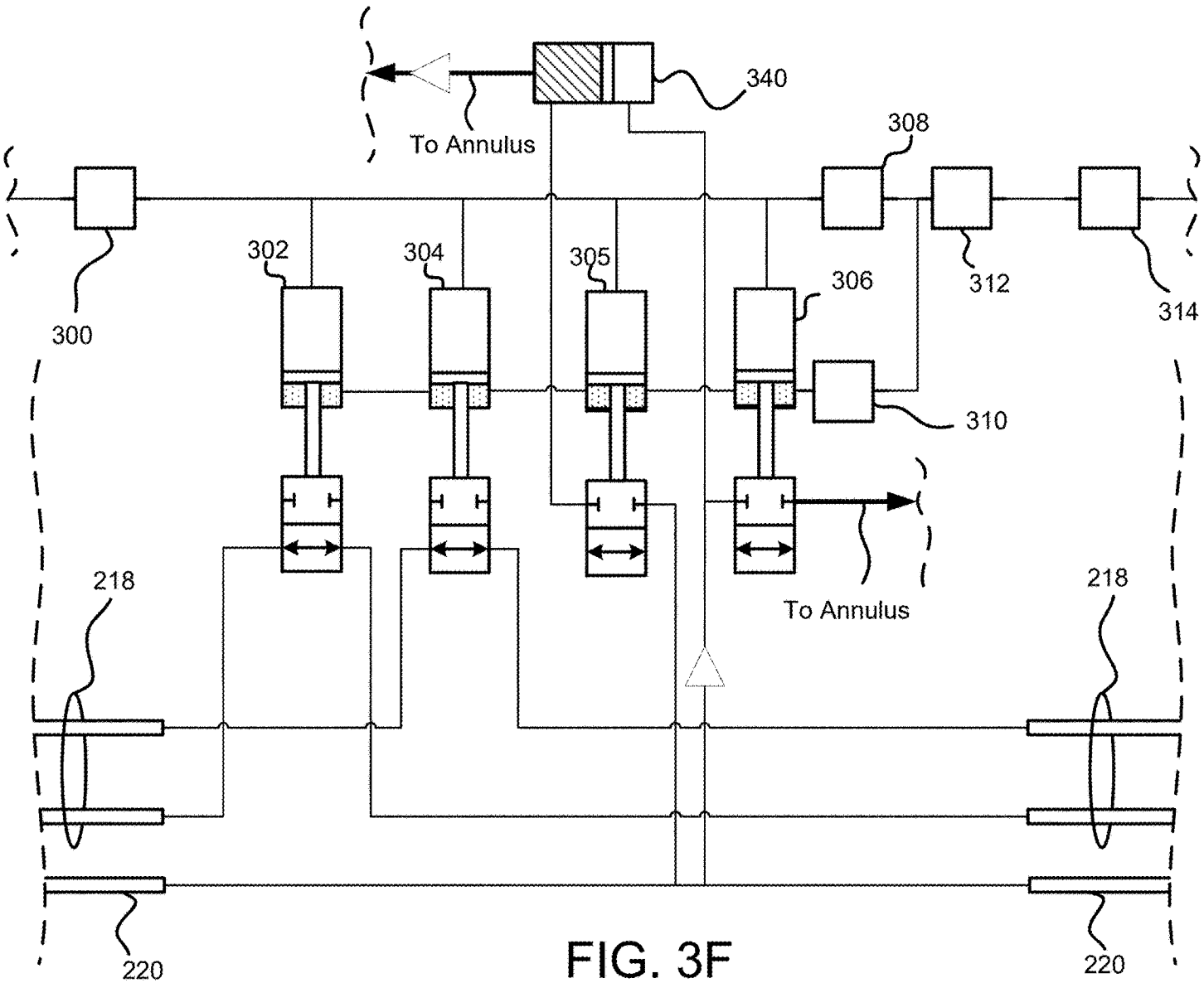
Figure 3G:
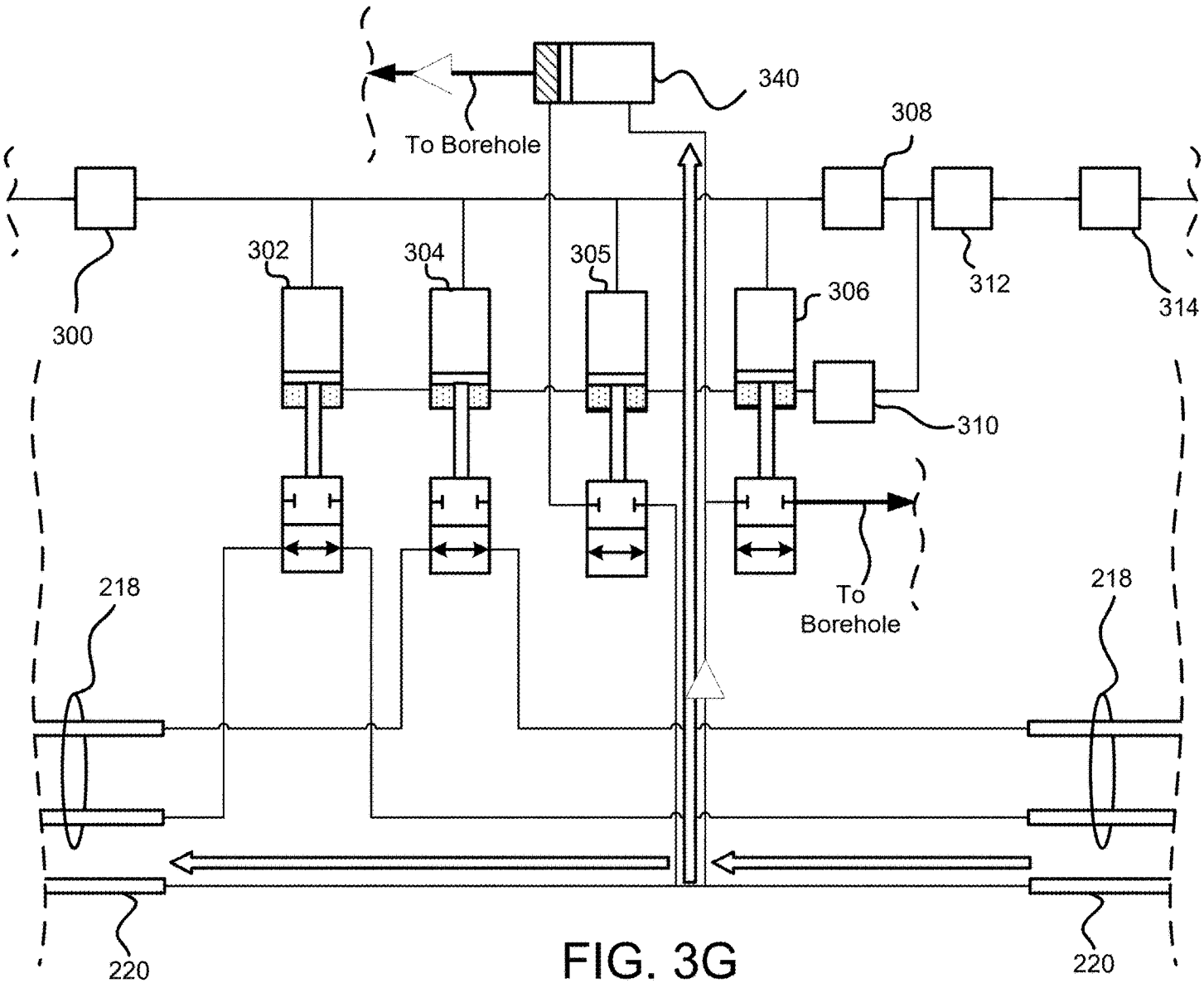
Figure 3H:
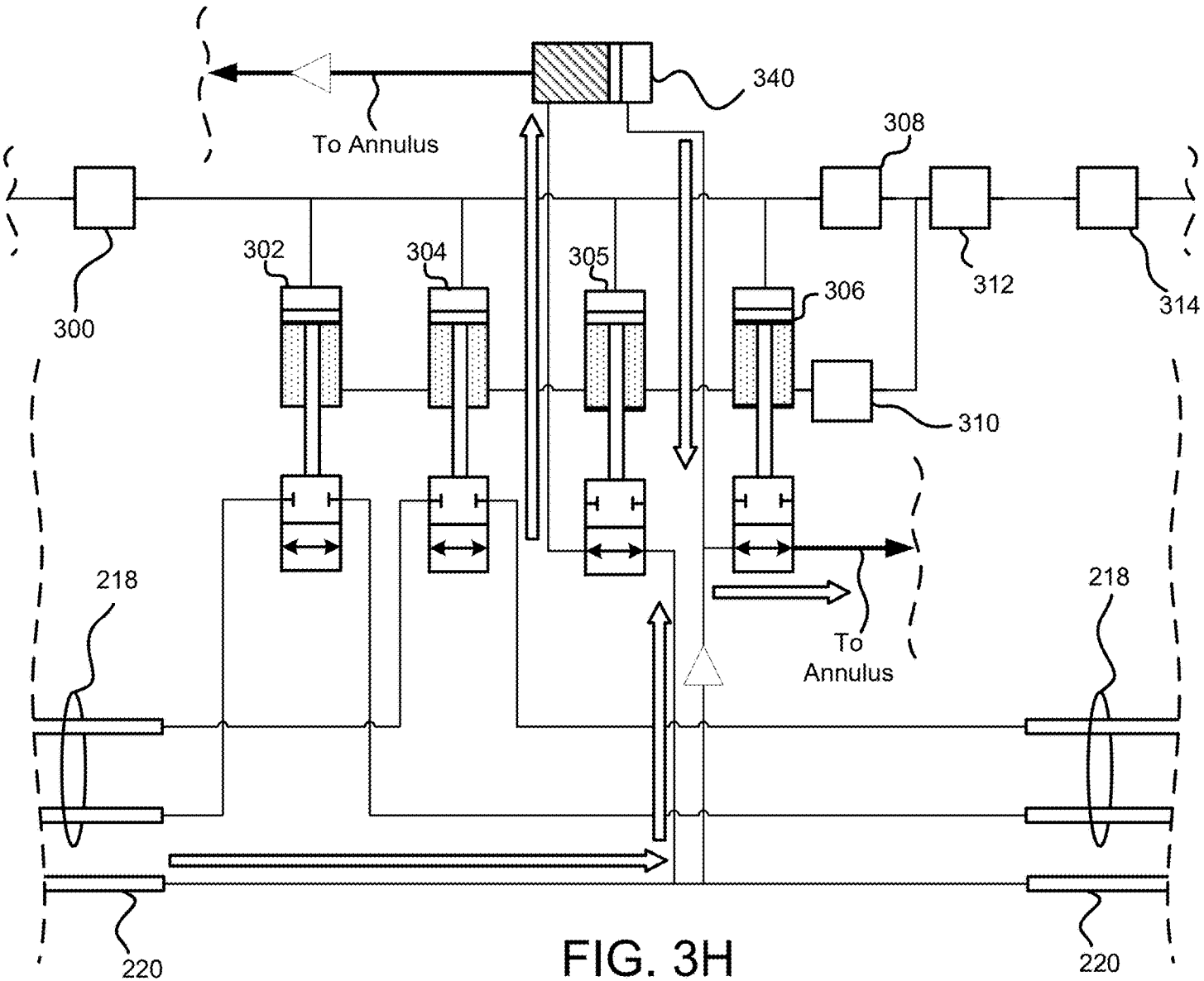

Turning to FIGS. 3F-3H, block diagrams illustrating another example control functionality of control assembly 291 in accordance with an embodiment is shown. In FIGS. 3F-3H, control assembly 291 may include, in addition to the components shown in FIGS. 3A, 3B, and 3D, isolation valve 305, accumulator 340, and additional one way valve (e.g., illustrated using triangles positioned over some of the lines through which fluid may flow).

Rather than relying on surface pumping, accumulator 340 may be used to store energy usable to evacuate fluid from the hydraulic chamber of the circulation assembly. For example, as seen in FIG. 3F, while not charged, isolation valves 302, 304 may be open while isolation valves 305-306 may be closed. To charge accumulator 340, normal pumping of fluid by the hydraulic assembly via flowline 220 to move the piston to the closed position may also cause fluid to flow into accumulator 340 (e.g., via the line attached to the portion of accumulator 340 on the right). The pumped fluid may compress a spring or other energy storage component.

FIG. 3G shows a diagram illustrating an example of pumping by the hydraulic assembly. In FIG. 3G, oversized arrows are used to indicate flows of fluid (e.g., in this case to the hydraulic chamber of the circulation assembly and accumulator 340). The pumping may cause the energy to be stored in accumulator 340.

By virtue of the stored energy in accumulator 340, the piston may be returned to the open position if the hydraulic assembly is unable to pump fluid out of the hydraulic chamber of the circulation assembly.

For example, turning to FIG. 3H, if the hydraulic assembly is unable to pump fluid out of the hydraulic chamber via flowline 220 while the piston is in the closed position and the hydraulic chamber of the circulation assembly is pressurized, valve 308 may be activated. When so activated, isolation valves 302-304 may close, and isolation valves 305-306 may open. This change in valve configuration may enable the energy stored in accumulator 340 to pump fluid out of accumulator 340 via isolation valve 306 and out into the annulus. Additionally, fluid from flowline 220 may be drawn into accumulator 340 via isolation valve 305 (e.g., the piston in accumulator 340 may move as the energy is released creating a vacuum that draws in fluid from flowline 220). Fluid from the hydraulic chamber of the circulation assembly may be similarly drawn down flowline 220, thereby applying force to the piston to move the piston from the closed to the open position. Consequently, the piston may move similarly as described with respect to FIGS. 3C and 3E, but without need for pumping from the surface.

While illustrated in FIGS. 3A-3H as including an example set of components (e.g., valve assembly, arming component, etc.) that operate via hydraulic action, it will be appreciated that control assembly may be implemented using components. For example, electric motors or other types of actuators may be used to apply force to the piston of the circulation assembly to move it from the open to the closed position.

Figure 4:
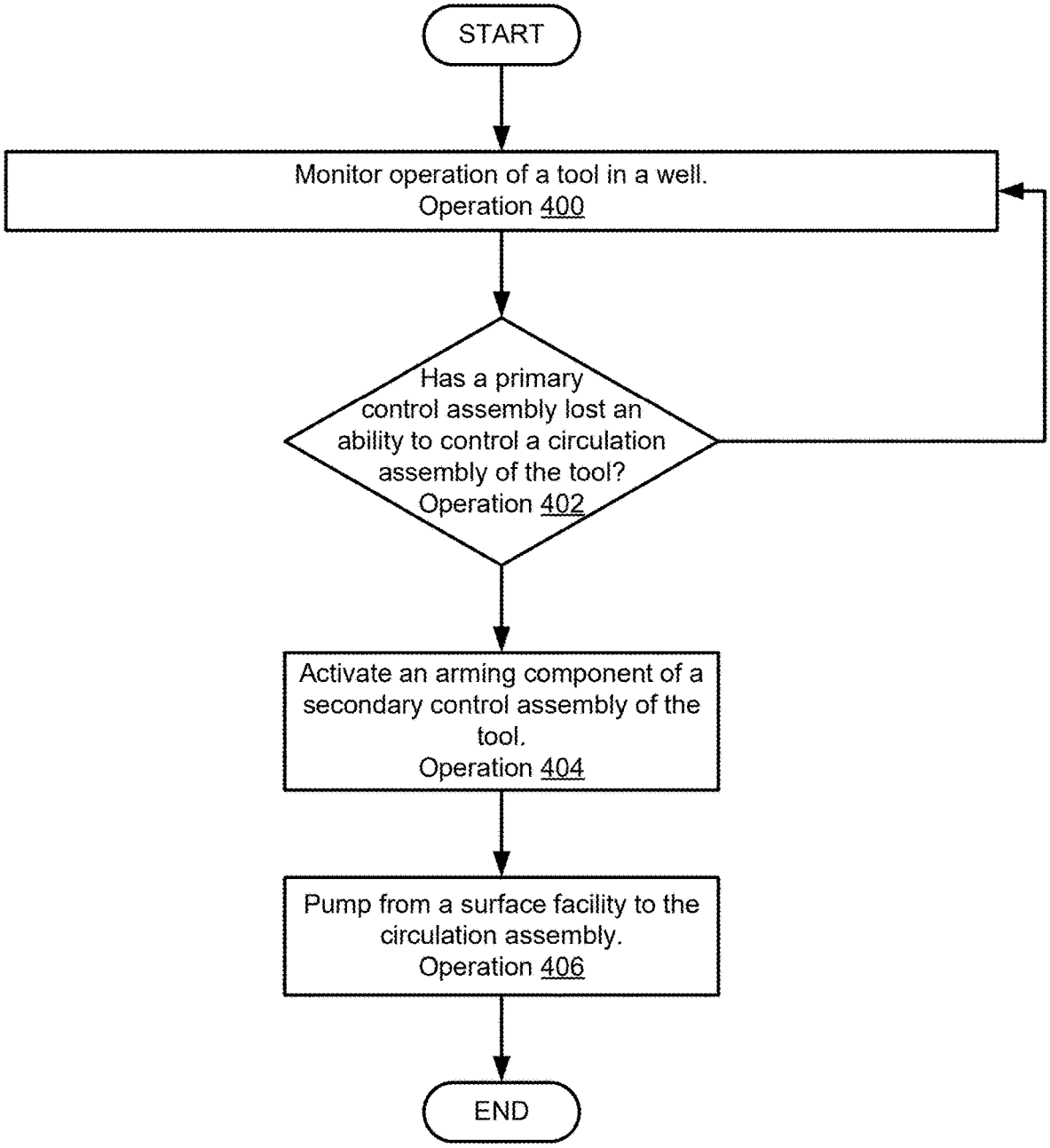
FIG. 4 shows a flow diagram illustrating a method in accordance with an embodiment.

As discussed above, the components of FIG. 1 may be used to perform various methods to facilitate analysis and completion of wells. FIG. 4 may illustrate a method that may be performed by the components of the system of FIG. 1. In the diagram discussed below and shown in FIG. 4, any of the operations may be repeated, performed in different orders, and/or performed in parallel with or in a partially overlapping in time manner with other operations.

Turning to FIG. 4, a flow diagram illustrating a method for managing operation of tool in accordance with an embodiment is shown. The method may be performed, for example, by any of the components of the system shown in FIGS. 1 and 5.

Prior to operation 400, the tool may be prepared for downhole operation, and then positioned in the well. The tool may be prepared, for example, by placing isolation valves of a secondary control assembly (e.g., control assembly 291) in states similar to that depicted in FIG. 3A or 3G. Once positioned in the well, various downhole operations may be performed. The downhole operations may include transient testing. To perform the transient testing, the tool may be placed in a state similar to that illustrated in FIGS. 2D, 3A, and/or 3G. When in the aforementioned state, the interior of the tool may be isolated from the annulus. Consequently, material may not be able to be pumped into the annulus for stability operation. To facilitate pumping into the annulus from the surface, the position of a piston of the circulation assembly may need to be modified.

However, if the primary control assembly has lost the ability to reposition the piston, then a secondary control assembly may be used. To ascertain whether to use the primary control assembly or the secondary control assembly to reposition the piston, operation 400 may be performed.

At operation 400, operation of the tool in a well is monitored. The operation may be monitored by obtaining telemetry data from the tool via a wireline signaling or any other type of communication system. The telemetry data may indicate states of assemblies (and/or component thereof) of the tool.

For example, the tool may include a bottom hole assembly similar to that illustrated in FIGS. 2A-3H. The telemetry data may indicate whether a hydraulic assembly is capable of pumping fluid to and/or from a circulation assembly. The telemetry data may include different information regarding the bottom hole assembly usable to diagnose whether a piston of the circulation assembly may be moved using a primary control assembly (e.g., the hydraulic assembly).

The telemetry data may also be usable to ascertain a state of the well. The state of the well may be used to identify whether remedial operations should be performed to maintain stability and/or safety of the well.

At operation 402, a determination is made regarding whether the primary control assembly has lost the ability to control the circulation assembly of the tool. The determination may be made by comparing the telemetry data to criteria. The criteria may specify values or other information regarding the telemetry data that indicate whether pumps of the primary control assembly are operational and usable to actuate the piston of the circulation assembly.

If it is determined that the primary control assembly has lost the ability to control the circulation assembly, then the method may proceed to operation 404. Otherwise, the method may return to operation 400.

At operation 404, an arming component of the secondary control assembly of the tool is activated. The arming component may be activated by, for example, sending a control signal from a topside facility or other control system to the arming component. The arming component may take action based on the control signal. The control signal may indicate, for example, that a valve of the arming component is to be activated (e.g., actuated, powered, energized, etc.). If the control signal indicates that the arming component is to be activated, then power or other utility may be provided to the arming component to active the arming component.

When so activated, the secondary control assembly may apply various pressures to the circulation assembly to move the piston of the circulation assembly to the open position. For example, any of the processes illustrated in FIGS. 3A-3H may be performed when the arming component is activated. Accordingly, hydraulic force may be applied to the piston that may tend to move it toward the open position.

The arming component may include a circuit and/or valve. The circuit may be primed to energize or otherwise operate the valve. The valve may, as discussed with respect to FIGS. 3A-3H, cause various hydraulic forces to be applied to reconfigure the circulation assembly.

At operation 406, a surface facility pumps to the circulation assembly. The surface facility may pump any material down a drill string to the circulation assembly. When pumped, the material may apply pressure on the piston as discussed with respect to FIG. 3E. The applied pressure may tend to move piston 210 toward the open position.

The method may end following operation 406.

Once the piston is in the open position, various surface facility pumping may be performed to stabilize the well and/or the tool, to perform downhole operations that may require an opening in the bottom hole assembly, and/or other actions may be performed (e.g., the tool or portions thereof may be removed from the well for repair).

Consequently, both test results and the tool may be more likely to be obtained from the well even while portions of the tool fail. Once the test results are obtained, the test results may be used to deduce properties of the geological formation and/or grade the interval with respect to various potential uses such as production, sequestration, etc. The analysis may then be used to establish a completion plan and/or exploitation plan (and/or may be used for other purposes). To do so, a system similar to that shown in FIG. 5 may be used.

Figure 5:
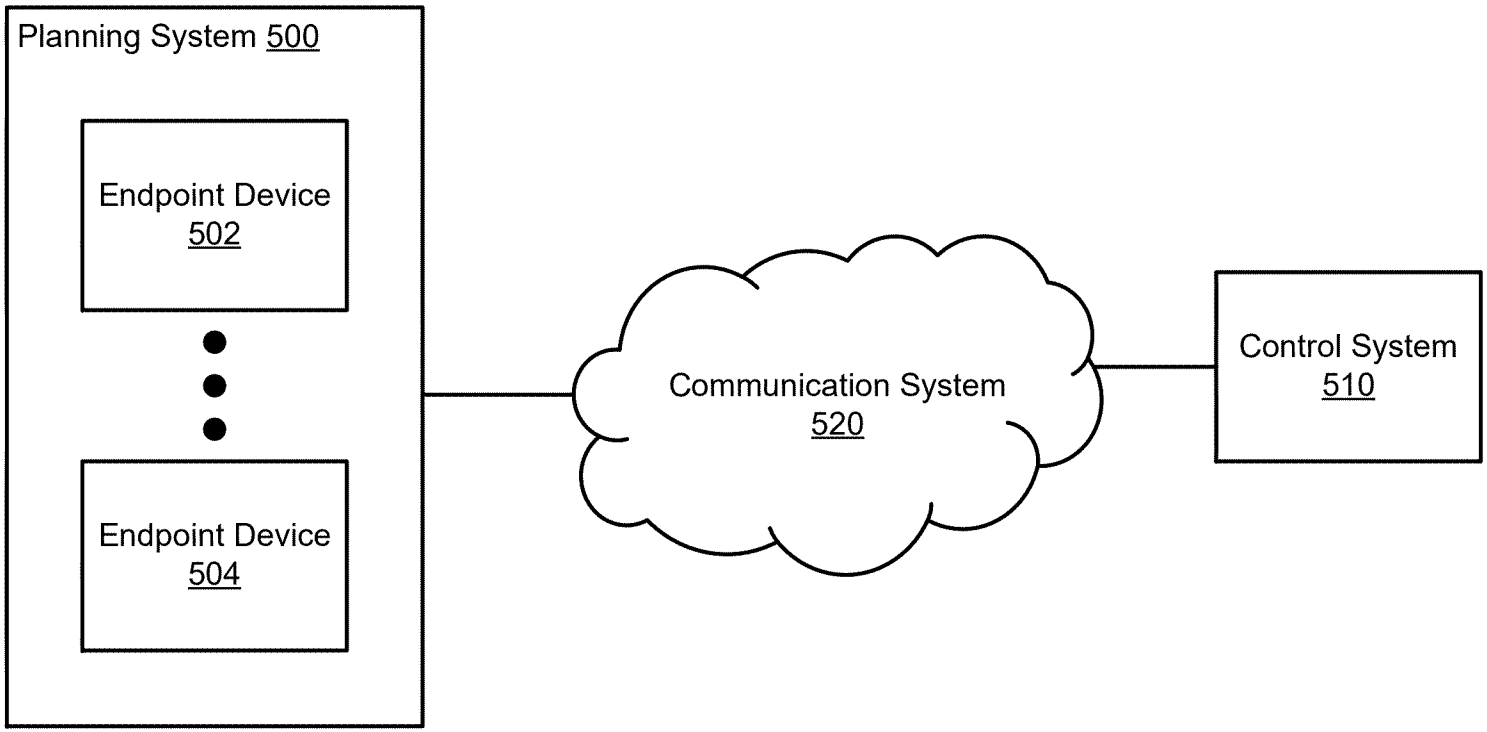
FIG. 5 shows a block diagram of a system in accordance with an embodiment.

Turning to FIG. 5, a block diagram of a modeling system in accordance with an embodiment is shown. The modeling system may be used to establish completion and/or exploitation plans for wells.

To provide the above noted functionality, the modeling system of FIG. 5 may include planning system 500, control system 510, and communication system 520. Each of these components is discussed below.

Planning system 500 may facilitate completion planning for wells. To do so, planning system 500 may gather and provide information regarding a not-yet-completed well and perform various analysis of the collected information. The collected information may include results obtained using the tool shown in FIG. 1.

Based on the testing results, various properties of the geological formation in which a wellbore is positioned as well as gradings for intervals may be obtained. Planning system 500 may use this information to define a completion/exploitation plan, and/or manage completion of a well based on the completion/exploitation plan.

For example, planning system 500 may use the graded intervals to define a topology of the completed well. The topology may be defined in an automated manner (e.g., automatic selection of where the well will interact with the geologic formation), semi-automated (e.g., suggest where the well will interact with the geologic formation, allow a subject matter expert to confirm/reject/modify the suggestion), and/or manual manner (e.g., allow the subject matter expert to review and use the information to define the completion plan).

To provide its functionality, planning system 500 may include any number of endpoint devices 502-504. The endpoint devices may include various types of computing devices used by personnel working on completion of the wells.

Control system 510 may include one or more computing units (e.g., central processing units, microcontrollers, etc.) of tool 100 used to manage the operation of tool 100. For example, the computing units may store code usable to manage operation of the assemblies of tool 100 to perform transient testing, identify failures of portions of the tool, and/or perform other downhole operations. During the transient testing, the computing units may read various sensors (e.g., flow, pressure, etc.) positioned to capture information usable to derive information regarding and/or grade intervals for various purposes thereby obtaining various test results. Additionally, the computing units may provide telemetry data usable to diagnose the health of various portions of the tool. When certain downhole conditions are identified and undesired health states of the tool are identified, then the control system may send instructions to that tool that cause the secondary control assembly to perform the operations discussed with respect to FIGS. 3A-3H When providing their functionality, any of (and/or components thereof) planning system 500 and control system 510 may perform all, or a portion, of the actions and methods illustrated in FIGS. 2A-4.

Any of (and/or components thereof) planning system 500 and control system 510 may be implemented using a computing device (also referred to as a data processing system) such as a host or a server, a personal computer (e.g., desktops, laptops, and tablets), a "thin" client, a personal digital assistant (PDA), a Web enabled appliance, a mobile phone (e.g., Smartphone), an embedded system, local controllers, an edge node, and/or any other type of data processing device or system. For additional details regarding computing devices, refer to FIG. 6.

Any of the components illustrated in FIG. 5 may be operably connected to each other (and/or components not illustrated) with communication system 520. In an embodiment, communication system 520 includes one or more networks that facilitate communication between any number of components, wirelines (e.g., point to point communication links), and/or other communication infrastructure. The networks may include wired networks and/or wireless networks (e.g., and/or the Internet). The networks may operate in accordance with any number and types of communication protocols (e.g., such as the internet protocol).

While illustrated in FIG. 5 as including a limited number of specific components, a system in accordance with an embodiment may include fewer, additional, and/or different components than those illustrated therein.

Thus, using the method illustrated in FIG. 4 and system illustrated in FIGS. 1-3H and 5, embodiments disclosed herein may improve the likelihood of successfully exploiting geological formation for various purposes. The likelihood of success may be improved by performing transient tests on the geological formation in which wells are positioned. The transient testing results may facilitate modeling and understanding how various geological formation may respond to certain uses. During the testing, conditions of the well and/or tool may be monitored for signs of undesired conditions in the well and health of the tool. If undesired conditions and poor health of the tool (or more specifically primary control assemblies) is identified, then secondary control assemblies may be used to manage operation of the tool to address the undesired conditions (e.g., well instability due to pressure imbalances between drill strings and the annulus, etc.).

Thus, embodiments disclosed herein may address the technical challenge of acquisition of downhole information usable to grade geological formations for various purposes. The disclosed embodiments may do so by compensating for failures of portions of downhole tools.

Figure 6:
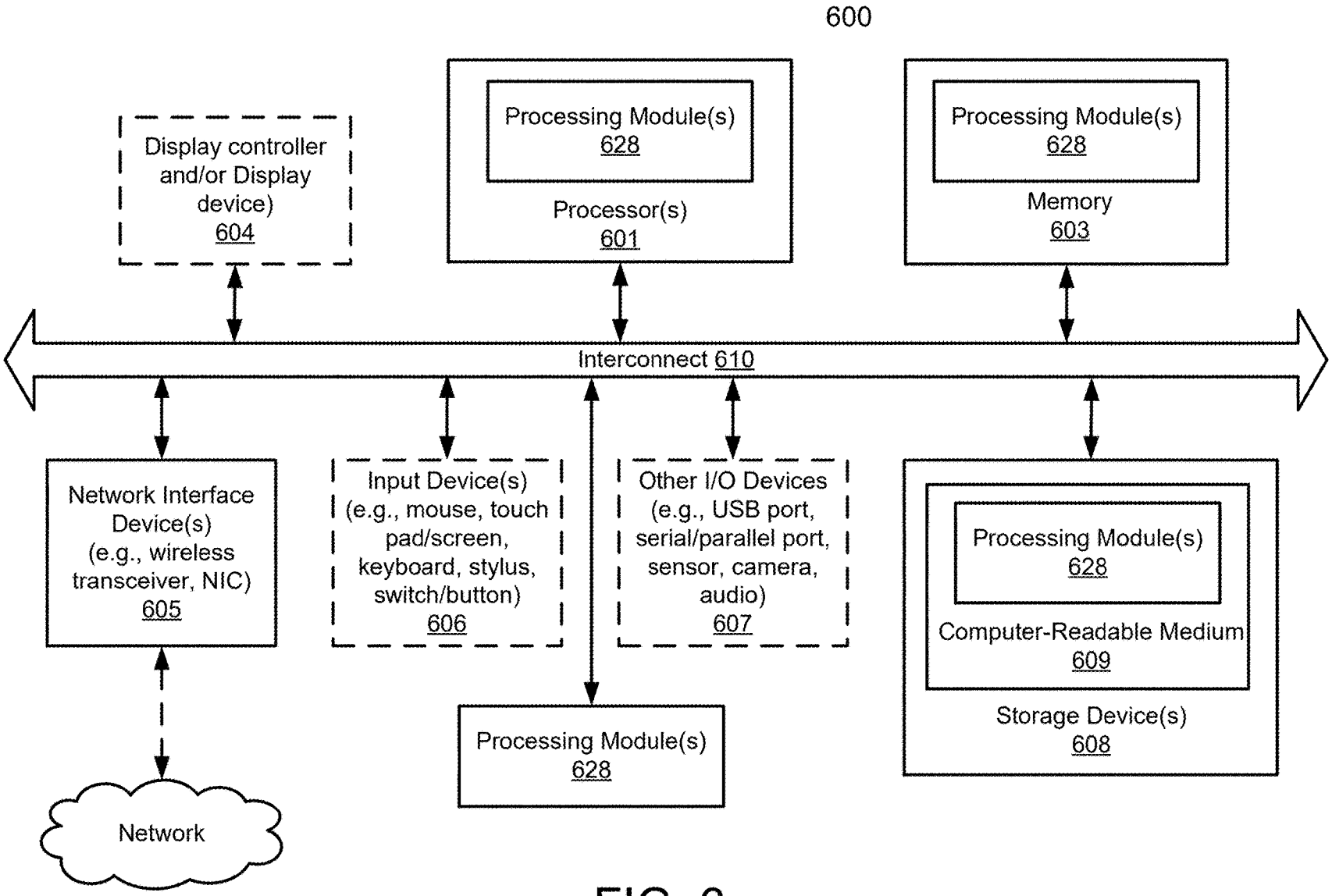
FIG. 6 shows a block diagram illustrating a data processing system in accordance with an embodiment.

Any of the components illustrated in FIGS. 1-5 may be implemented with one or more computing devices. Turning to FIG. 6, a block diagram illustrating an example of a data processing system (e.g., a computing device) in accordance with an embodiment is shown. For example, system 600 may represent any of data processing systems described above performing any of the processes or methods described above. System 600 can include many different components. These components can be implemented as integrated circuits (ICs), portions thereof, discrete electronic devices, or other modules adapted to a circuit board such as a motherboard or add-in card of the computer system, or as components otherwise incorporated within a chassis of the computer system. Note also that system 600 is intended to show a high level view of many components of the computer system. However, it is to be understood that additional components may be present in certain implementations and furthermore, different arrangement of the components shown may occur in other implementations. System 600 may represent a desktop, a laptop, a tablet, a server, a mobile phone, a media player, a personal digital assistant (PDA), a personal communicator, a gaming device, a network router or hub, a wireless access point (AP) or repeater, a set-top box, or a combination thereof. Further, while only a single machine or system is illustrated, the term "machine" or "system" shall also be taken to include any collection of machines or systems that individually or jointly execute a set (or multiple sets) of instructions to perform any one or more of the methodologies discussed herein.

In an embodiment, system 600 includes processor 601, memory 603, and devices 605-607 via a bus or an interconnect 610. Processor 601 may represent a single processor or multiple processors with a single processor core or multiple processor cores included therein. Processor 601 may represent one or more general-purpose processors such as a microprocessor, a central processing unit (CPU), or the like. More particularly, processor 601 may be a complex instruction set computing (CISC) microprocessor, reduced instruction set computing (RISC) microprocessor, very long instruction word (VLIW) microprocessor, or processor implementing other instruction sets, or processors implementing a combination of instruction sets. Processor 601 may also be one or more special-purpose processors such as an application specific integrated circuit (ASIC), a cellular or baseband processor, a field programmable gate array (FPGA), a digital signal processor (DSP), a network processor, a graphics processor, a network processor, a communications processor, a cryptographic processor, a co-processor, an embedded processor, or any other type of logic capable of processing instructions.

Processor 601, which may be a low power multi-core processor socket such as an ultra-low voltage processor, may act as a main processing unit and central hub for communication with the various components of the system. Such processor can be implemented as a system on chip (SoC). Processor 601 is configured to execute instructions for performing the operations discussed herein. System 600 may further include a graphics interface that communicates with optional graphics subsystem 604, which may include a display controller, a graphics processor, and/or a display device.

Processor 601 may communicate with memory 603, which in an embodiment can be implemented via multiple memory devices to provide for a given amount of system memory. Memory 603 may include one or more volatile storage (or memory) devices such as random access memory (RAM), dynamic RAM (DRAM), synchronous DRAM (SDRAM), static RAM (SRAM), or other types of storage devices. Memory 603 may store information including sequences of instructions that are executed by processor 601, or any other device. For example, executable code and/or data of a variety of operating systems, device drivers, firmware (e.g., input output basic system or BIOS), and/or applications can be loaded in memory 603 and executed by processor 601. An operating system can be any kind of operating systems, such as, for example, Windows® operating system from Microsoft®, Mac OS®/iOS® from Apple, Android® from Google®, Linux®, Unix®, or other real-time or embedded operating systems such as VxWorks.

System 600 may further include IO devices such as devices (e.g., 605, 606, 607, 608) including network interface device(s) 605, optional input device(s) 606, and other optional IO device(s) 607. Network interface device(s) 605 may include a wireless transceiver and/or a network interface card (NIC). The wireless transceiver may be a WiFi transceiver, an infrared transceiver, a Bluetooth transceiver, a WiMax transceiver, a wireless cellular telephony transceiver, a satellite transceiver (e.g., a global positioning system (GPS) transceiver), or other radio frequency (RF) transceivers, or a combination thereof. The NIC may be an Ethernet card.

Input device(s) 606 may include a mouse, a touch pad, a touch sensitive screen (which may be integrated with a display device of optional graphics subsystem 604), a pointer device such as a stylus, and/or a keyboard (e.g., physical keyboard or a virtual keyboard displayed as part of a touch sensitive screen). For example, input device(s) 606 may include a touch screen controller coupled to a touch screen. The touch screen and touch screen controller can, for example, detect contact and movement or break thereof using any of a plurality of touch sensitivity technologies, including but not limited to capacitive, resistive, infrared, and surface acoustic wave technologies, as well as other proximity sensor arrays or other elements for determining one or more points of contact with the touch screen.

IO devices 607 may include an audio device. An audio device may include a speaker and/or a microphone to facilitate voice-enabled functions, such as voice recognition, voice replication, digital recording, and/or telephony functions. Other IO devices 607 may further include universal serial bus (USB) port(s), parallel port(s), serial port(s), a printer, a network interface, a bus bridge (e.g., a PCI-PCI bridge), sensor(s) (e.g., a motion sensor such as an accelerometer, gyroscope, a magnetometer, a light sensor, compass, a proximity sensor, etc.), or a combination thereof. IO device(s) 607 may further include an imaging processing subsystem (e.g., a camera), which may include an optical sensor, such as a charged coupled device (CCD) or a complementary metal-oxide semiconductor (CMOS) optical sensor, utilized to facilitate camera functions, such as recording photographs and video clips. Certain sensors may be coupled to interconnect 610 via a sensor hub (not shown), while other devices such as a keyboard or thermal sensor may be controlled by an embedded controller (not shown), dependent upon the specific configuration or design of system 600.

To provide for persistent storage of information such as data, applications, one or more operating systems and so forth, a mass storage (not shown) may also couple to processor 601. In an embodiments, to enable a thinner and lighter system design as well as to improve system responsiveness, this mass storage may be implemented via a solid state device (SSD). In an embodiments, the mass storage may primarily be implemented using a hard disk drive (HDD) with a smaller amount of SSD storage to act as an SSD cache to enable non-volatile storage of context state and other such information during power down events so that a fast power up can occur on re-initiation of system activities. Also a flash device may be coupled to processor 601, e.g., via a serial peripheral interface (SPI). This flash device may provide for non-volatile storage of system software, including a basic input/output software (BIOS) as well as other firmware of the system.

Storage device 608 may include computer-readable storage medium 609 (also known as a machine-readable storage medium or a computer-readable medium) on which is stored one or more sets of instructions or software (e.g., processing module, unit, and/or processing module/unit/logic 628) embodying any one or more of the methodologies or functions described herein. Processing module/unit/logic 628 may represent any of the components described above. Processing module/unit/logic 628 may also reside, completely or at least partially, within memory 603 and/or within processor 601 during execution thereof by system 600, memory 603 and processor 601 also constituting machine-accessible storage media. Processing module/unit/logic 628 may further be transmitted or received over a network via network interface device(s) 605.

Computer-readable storage medium 609 may also be used to store some software functionalities described above persistently. While computer-readable storage medium 609 is shown in an embodiment to be a single medium, the term "computer-readable storage medium" should be taken to include a single medium or multiple media (e.g., a centralized or distributed database, and/or associated caches and servers) that store the one or more sets of instructions. The terms "computer-readable storage medium" shall also be taken to include any medium that is capable of storing or encoding a set of instructions for execution by the machine and that cause the machine to perform any one or more of the methodologies of embodiments disclosed herein. The term "computer-readable storage medium" shall accordingly be taken to include, but not be limited to, solid-state memories, and optical and magnetic media, or any other non-transitory machine-readable medium.

Processing module/unit/logic 628, components and other features described herein can be implemented as discrete hardware components or integrated in the functionality of hardware components such as ASICS, FPGAs, DSPs or similar devices. In addition, processing module/unit/logic 628 can be implemented as firmware or functional circuitry within hardware devices. Further, processing module/unit/logic 628 can be implemented in any combination hardware devices and software components.

Note that while system 600 is illustrated with various components of a data processing system, it is not intended to represent any particular architecture or manner of interconnecting the components; as such details are not germane to embodiments disclosed herein. It will also be appreciated that network computers, handheld computers, mobile phones, servers, and/or other data processing systems which have fewer components or perhaps more components may also be used with embodiments disclosed herein.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Embodiments disclosed herein also relate to an apparatus for performing the operations herein. Such a computer program is stored in a non-transitory computer readable medium. A non-transitory machine-readable medium includes any mechanism for storing information in a form readable by a machine (e.g., a computer). For example, a machine-readable (e.g., computer-readable) medium includes a machine (e.g., a computer) readable storage medium (e.g., read only memory ("ROM"), random access memory ("RAM"), magnetic disk storage media, optical storage media, flash memory devices).

The processes or methods depicted in the preceding figures may be performed by processing logic that comprises hardware (e.g. circuitry, dedicated logic, etc.), software (e.g., embodied on a non-transitory computer readable medium), or a combination of both. Although the processes or methods are described above in terms of some sequential operations, it should be appreciated that some of the operations described may be performed in a different order. Moreover, some operations may be performed in parallel rather than sequentially.

Embodiments disclosed herein are not described with reference to any particular programming language. It will be appreciated that a variety of programming languages may be used to implement the teachings of embodiments disclosed herein.

In the foregoing specification, embodiments have been described with reference to specific exemplary embodiments thereof. It will be evident that various modifications may be made thereto without departing from the broader spirit and scope of the embodiments disclosed herein as set forth in the following claims. The specification and drawings are, accordingly, to be regarded in an illustrative sense rather than a restrictive sense.

What is claimed is:

1. A tool for use with respect to a well, the tool comprising:

a circulation assembly adapted to reversibly place a fluid line to a surface facility in fluid communication with an annulus;

a primary control assembly adapted to control the circulation assembly to reversibly place the fluid line to the surface facility in fluid communication with the annulus; and a secondary control assembly comprising:

an actuator adapted to override the control of the circulation assembly by the primary control assembly to control the circulation assembly while the primary control assembly is unable to control the circulation assembly; and an arming component adapted to actuate the actuator, wherein the actuator comprises:

a valve assembly operably connected to flowlines between the circulation assembly and the primary control assembly, the flowlines enabling the primary control assembly to control operation of the circulation assembly, wherein the valve assembly, when actuated by the arming component, is adapted to:

isolate a first flowline of the flowlines from the fluid line; and place a second flowline of the flowlines in fluid communication with the annulus.

2. The tool of claim 1, wherein the second flowline is adapted to be placed in fluid communication with a hydraulic chamber of the circulation assembly.

3. The tool of claim 2, wherein the hydraulic chamber is isolated from the fluid line by a piston.

4. The tool of claim 3, wherein the piston is adapted to reversibly seal an opening in the circulation assembly, wherein when the opening is sealed, the fluid line is isolated from the annulus, and wherein when the opening is unsealed, the fluid line is in fluid communication with the annulus.

5. The tool of claim 4, wherein the primary control assembly comprises a pump that is adapted to pump a fluid via the second flowline with respect to the hydraulic chamber to actuate the piston to reversibly seal the opening.

6. The tool of claim 1, wherein the actuator further comprises a reservoir adapted to receive pressurized fluid from isolation valves of the valve assembly when the valve assembly is actuated by the arming component.

7. The tool of claim 6, wherein the arming component comprises a surface facility controlled valve adapted to reversibly place the pressurized fluid in fluid communication with the reservoir when the arming component actuates the valve assembly.

8. The tool of claim 6, wherein the pressurized fluid is positioned with the isolation valves while the tool is not in the well.

9. The tool of claim 1, wherein the secondary control assembly operates independently from the primary control assembly.

10. A method of managing testing of a well that is positioned with a geological formation, comprising:

while a tool is positioned in the well for the testing:

making an identification that a primary control assembly adapted to control a circulation assembly to reversibly place a fluid line to a surface in fluid communication with an annulus has lost an ability to control the circulation assembly;

based on the identification:

activating an arming component of a secondary control assembly of the tool to override the control of the circulation assembly by the primary control assembly to control the circulation assembly while the primary control assembly is unable to control the circulation assembly, wherein the arming component is adapted to actuate an actuator, the actuator being adapted to override the control of the circulation assembly by the primary control assembly to control the circulation assembly while the primary control assembly is unable to control the circulation assembly, and wherein the actuator comprises:

a valve assembly operably connected to flowlines between the circulation assembly and the primary control assembly, the flowlines enabling the primary control assembly to control operation of the circulation assembly, wherein the valve assembly, when actuated by the arming component, is adapted to:

isolate a first flowline of the flowlines from the fluid line; and place a second flowline of the flowlines in fluid communication with the annulus; and after activating the arming component:

pumping from a surface facility to actuate the circulation assembly to place the fluid line to the surface in fluid communication with the annulus.

11. The method of claim 10, wherein the second flowline is adapted to be placed in fluid communication with a hydraulic chamber of the circulation assembly.

12. The method of claim 11, wherein the hydraulic chamber is isolated from the fluid line by a piston.

13. The method of claim 12, wherein the piston is adapted to reversibly seal an opening in the circulation assembly, wherein when the opening is sealed, the fluid line is isolated from the annulus, and wherein when the opening is unsealed, the fluid line is in fluid communication with the annulus.

14. The method of claim 13, wherein the primary control assembly comprises a pump that is adapted to pump a fluid via the second flowline with respect to the hydraulic chamber to actuate the piston to reversibly seal the opening.

15. The method of claim 10, wherein the actuator further comprises a reservoir adapted to receive pressurized fluid from isolation valves of the valve assembly when the valve assembly is actuated by the arming component.

16. The method of claim 15, wherein the arming component comprises a surface facility controlled valve adapted to reversibly place the pressurized fluid in fluid communication with the reservoir when the arming component actuates the valve assembly.

17. The method of claim 15, wherein the pressurized fluid is positioned with the isolation valves while the tool is not in the well.

* * * * *